US009422039B2

(12) United States Patent
Smith et al.

(10) Patent No.: US 9,422,039 B2
(45) **Date of Patent: *Aug. 23, 2016**

(54) SUSPENDED MARINE PLATFORM

(71) Applicants: David Alvin Smith, Sidney (CA); Lee Michael Adams, Parksville (CA)

(72) Inventors: David Alvin Smith, Sidney (CA); Lee Michael Adams, Parksville (CA)

(73) Assignee: Professional Components LTD, Sidney, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/639,091

(22) Filed: Mar. 4, 2015

(65) Prior Publication Data

US 2015/0329183 A1 Nov. 19, 2015

Related U.S. Application Data

(63) Continuation-in-part of application No. 14/007,551, filed as application No. PCT/CA2012/000291 on Mar. 29, 2012, now Pat. No. 9,016,226.

(60) Provisional application No. 61/469,514, filed on Mar. 30, 2011.

(51) Int. Cl.
*B63B 17/00* (2006.01)
*B63B 39/00* (2006.01)

(52) U.S. Cl.
CPC ..... *B63B 39/00* (2013.01); *B63B 17/00* (2013.01); *B63B 39/005* (2013.01); *B63B 2017/0072* (2013.01)

(58) Field of Classification Search
CPC ..... B63B 29/12; B63B 17/0081
See application file for complete search history.

(56) References Cited

U.S. PATENT DOCUMENTS

| | | | | |
|---|---|---|---|---|
| 3,237,906 | A * | 3/1966 | Heyl, Jr. | B60N 2/502 108/150 |
| 4,349,167 | A | 9/1982 | Reilly | |
| 4,911,381 | A | 3/1990 | Cannon et al. | |
| 5,542,371 | A | 8/1996 | Harvey et al. | |
| 6,182,596 | B1 * | 2/2001 | Johnson | B63B 1/22 114/279 |
| 6,237,889 | B1 | 5/2001 | Bischoff | |
| 6,786,172 | B1 | 9/2004 | Loffler | |
| 9,016,226 | B2 * | 4/2015 | Smith | B63B 17/0081 114/122 |

FOREIGN PATENT DOCUMENTS

WO 92/12892 8/1992

OTHER PUBLICATIONS

Canadian Intellectual Property Office,International Search Report, Jun. 13, 2012, 2 pages.

* cited by examiner

*Primary Examiner* — Edwin Swinehart
(74) *Attorney, Agent, or Firm* — Tomlinson Rust McKinstry Grable

(57) ABSTRACT

A suspension system for passenger modules or marine platforms used with high-speed boats, the suspension system including a shock absorbing assembly, for supporting the marine platform relative to the vessel. The marine platform is attached to the vessel via an assembly of pivoting spars in which the vessel attachment locations are spaced athwart a greater distance than the marine platform, and the attachment of some spars permits relative fore and aft movement between the spars and the marine platform or the vessel to accommodate pitch. The suspension system may include components for attenuating motion associated with roll.

16 Claims, 42 Drawing Sheets

300
220
302
304

300
302
220

220
300

300

300

300

350

350

450

450

220
270
500

500

500

500
220
270

220
270

500

550

550

650
230
270

750
220
270
230
270

220
276
270
274
270

750

220
270
230
750

750

800
220
230
270

850
220
270
230
220
850
270
270b
850

220
850
230
270
850

SUSPENDED MARINE PLATFORM

RELATED APPLICATION

This application is a continuation-in-part of U.S. application Ser. No. 14/007,551, filed Sep. 25, 2013, which is a US national entry of PCT/CA2012/000291 having an international filing date of Mar. 29, 2012, and which claims the benefit of U.S. Provisional Application No. 61/469,514, filed Mar. 30, 2011, the entire contents of which are incorporated herein by reference.

FIELD

The present invention relates to a suspended marine platform. More particularly, the present invention relates to a suspended marine platform for use in high-speed watercraft.

BACKGROUND

High-speed small boats are used in a variety of applications and are particularly useful in military operations, and search and rescue operations. When fast-moving small watercraft encounter even moderately disturbed water, the passengers are subjected to significant forces. At high-speed, in waves of any appreciable size, small watercraft tend to be subjected to rapid and simultaneous vertical and horizontal acceleration and deceleration.

When a boat moving at high speed impacts the crest of a wave, the boat tends to simultaneously pitch upwards and decelerate, and when it passes over or through the crest and encounters the trough, the boat tends to pitch downwards and accelerate. At high speed, each pitching and acceleration/deceleration cycle may be measured in seconds, such that passengers are subjected to rapid and extreme acceleration and deceleration and the associated shock, which is commonly quantified in terms of multiples of g, a "g" being a unit of acceleration equivalent to that exerted by the earth's gravitational field at the surface of the earth. The term g-force is also often used, but it is commonly understood to mean a relatively long-term acceleration. A short-term acceleration is usually called a shock and is also quantified in terms of g.

Human tolerances for shock and g-force depend on the magnitude of the acceleration, the length of time it is applied, the direction in which it acts, the location of application, and the posture of the body. When vibration is experienced, relatively low peak g levels can be severely damaging if they are at the resonance frequency of organs and connective tissues. In high-speed watercraft, with the passengers sitting in a conventional generally upright position, which is typically required, particularly with respect to the helmsperson and any others charged with watchkeeping, upward acceleration of the watercraft is experienced as a compressive force to an individual's spine and rapid deceleration tends to throw an individual forward.

Shock absorbing systems for high-speed boats are known. For example, U.S. Pat. No. 6,786,172 (Loffler—Shock absorbing boat) discloses a horizontal base for supporting a steering station that that is hingedly connected to the transom to pivot about a horizontal axis. The base is supported by spring bias means connected to the hull.

Impact attenuation systems for aircraft seats are also known, as disclosed in: U.S. Pat. No. 4,349,167 (Reilly—Crash load attenuating passenger seat); U.S. Pat. No. 4,523,730 (Martin—Energy-absorbing seat arrangement); U.S. Pat. No. 4,911,381 (Cannon et al.—Energy absorbing leg assembly for aircraft passenger seats); U.S. Pat. No. 5,125,598 (Fox—Pivoting energy attenuating seat); and U.S. Pat. No. 5,152,578 Kiguchi—Leg structure of seat for absorbing impact energy.

Other seat suspension systems are also known, as disclosed in: U.S. Pat. No. 5,657,950 (Han et al.—Backward-leaning-movement seat leg structure); U.S. patent application Ser. No. 10/907,931 (App.) (Barackman et al.—Adjustable attenuation system for a space re-entry vehicle seat); U.S. Pat. No. 3,572,828 (Lehner—Seat for vehicle preferably agricultural vehicle); U.S. Pat. No. 3,994,469 (Swenson et al.—Seat suspension including improved damping means); and U.S. Pat. No. 4,047,759 (Koscinski—Compact seat suspension for lift truck).

SUMMARY

In one aspect, the present invention provides a suspension system for a suspended marine platform on a high-speed water vessel having a usual direction of travel, the suspension system including: a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position; two spar assemblies, one spar assembly forward of the other spar assembly, and each spar assembly comprising a first spar and a second spar, each spar pivotally attached at a proximal end to the vessel and at a distal end to the marine platform, wherein: the proximal ends are aft of the distal ends; and the proximal ends of the spars are spaced athwart one from the other a greater distance than the distal ends of the spars are spaced athwart one from the other; wherein one spar assembly is forward of the other spar assembly; and wherein: the attachment of one spar assembly to the vessel permits relative fore and aft movement as between the spar and the vessel; or the attachment of one spar assembly to the marine platform permits relative fore and aft movement as between the spar and the marine platform.

The attachment of the one spar assembly to the marine platform preferably permits relative fore and aft movement as between the spar and the marine platform.

The relative fore and aft movement as between the spar and the marine platform may be linear. The relative fore and aft movement as between the spar and the marine platform may be provided by a track and car assembly.

The relative fore and aft movement as between the spar and the marine platform may be arcuate. The relative fore and aft movement as between the spar and the marine platform may be provided by a pivot assembly.

The suspension system may include a roll-attenuation assembly interconnected between the marine platform and the vessel. The roll-attenuation assembly including a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel.

In one of the spar assemblies, the first spar and second spar may be fixed one to the other in the vicinity of their distal ends and share a common pivotal attachment to the marine platform.

The shock absorbing assembly may include four shock-absorbing struts interconnected between the marine platform and the vessel.

In another aspect, the present invention provides a suspension system for a suspended marine platform on a high-speed water vessel having a usual direction of travel, the suspension system comprising: a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position; two spar assemblies, one spar assembly forward of the other spar assembly, and each spar assembly comprising a first spar and a second spar, each spar pivotally attached at a proximal end to the vessel and at a distal end to the marine platform, wherein: the proximal ends are aft of the distal ends; and the proximal ends of the spars are spaced athwart one from the other a greater distance than the distal ends of the spars are spaced athwart one from the other; wherein one spar assembly is forward of the other spar assembly; wherein the attachment of one spar assembly to the marine platform comprises a track and car assembly so as to permit relative linear fore and aft movement as between the spar and the marine platform; and further comprising a roll-attenuation assembly interconnected between the marine platform and the vessel.

The roll-attenuation assembly may include a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel. The shock absorbing assembly may include four shock-absorbing struts interconnected between the marine platform and the vessel.

In another aspect, the present invention includes a suspension system for a suspended marine platform on a high-speed water vessel having a usual direction of travel, the suspension system including: a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position; two spar assemblies, one spar assembly forward of the other spar assembly, and each spar assembly comprising a first spar and a second spar, each spar pivotally attached at a proximal end to the vessel and at a distal end to the marine platform, wherein: the proximal ends are aft of the distal ends; and the proximal ends of the spars are spaced athwart one from the other a greater distance than the distal ends of the spars are spaced athwart one from the other; wherein one spar assembly is forward of the other spar assembly; wherein the attachment of one spar assembly to the marine platform comprises a pivot assembly so as to permit relative arcuate fore and aft movement as between the spar and the marine platform; and further comprising a roll-attenuation assembly interconnected between the marine platform and the vessel.

The roll-attenuation assembly may include a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel. The shock absorbing assembly may include four shock-absorbing struts interconnected between the marine platform and the vessel.

DETAILED DESCRIPTION WITH REFERENCE TO THE DRAWINGS

Figure 1:
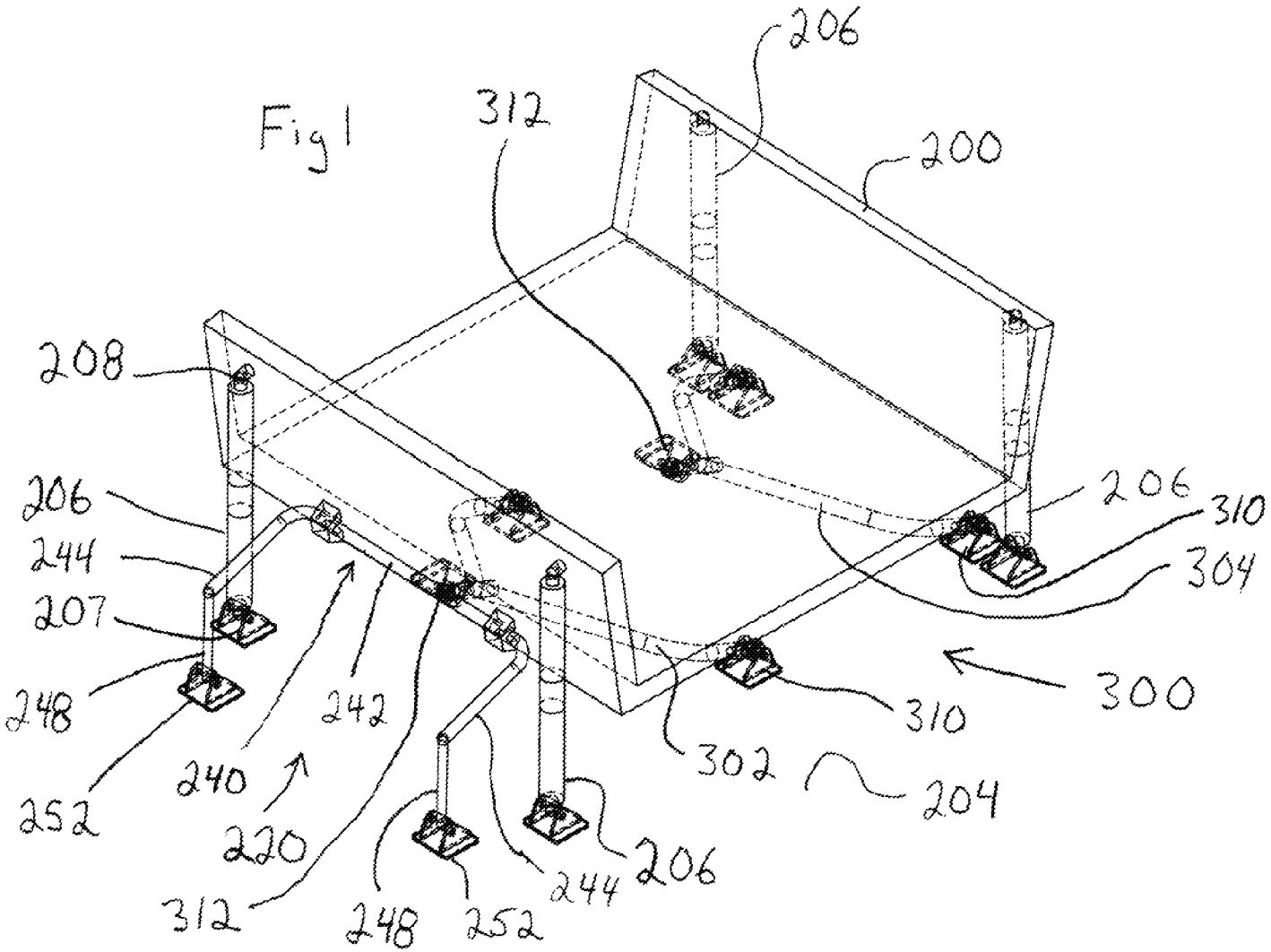
FIG. 1 is a forward-port-side isometric partially transparent view of a double-wishbone anti-sway embodiment of the present invention, shown in the at-rest position.

In this specification, including the claims, terms conveying an absolute direction (for example, up, down etc.) or absolute relative positions (for example, top, bottom etc.) are used for clarity of description and it is understood that such absolute directions and relative positions may not always pertain. As well, in this specification, including the claims, terms relating to directions and relative orientations on a watercraft, for example, port, starboard, forward, aft, fore and aft (which when used herein means a generally horizontal direction generally parallel to the direction of travel of the vessel), bow, stern, athwart (which when used herein means a generally horizontal direction generally perpendicular to the direction of travel of the vessel) etc. are used for clarity of description and it is understood that such terms may not always pertain.

As well, in this specification, including the claims, the terms "roll and "pitch" are used to refer to movement relative to an imaginary line parallel to the nominal direction of travel of the vessel or object, and passing through the center of mass of the vessel or object, with "roll" being quasi-pivotal or quasi-rotational lateral movement with respect to the imaginary line, and "pitch" being a generally vertical angle of displacement (e.g. bow up or bow down) caused by a vertical force applied at a distance from the center of mass.

In most of the figures, a marine platform 200 is represented in a simplified stylized manner, however it will be appreciated that in an actual installation, marine platform 200 may comprise several other features, including: contoured seats, windscreens, covers, vessel controls etc. As well, marine platform 200 may be a passenger module comprising a plurality of individual seats. Marine platform 200 may be configured for use with a variety of items, including a stretcher or stretchers, cargo, a cockpit, a pallet of seats, and may configured for interchangeable use with many different types of such items.

In the figures, a deck 204 is indicated as being below, and providing support for, the marine platform 200. In an actual installation, the marine platform 200 and the associated suspension system are typically mounted to the vessel, such as to an integral deck. However, in some installations, it may be preferable to mount the marine platform 200 and suspension system to a carriage (such as a suitable plate or framework) and to attach the carriage to the vessel.

The embodiments shown in the figures all have four shock absorbing struts 206, which serve to suspend marine platform 200 above deck 204, with each strut 206 shown as positioned in the general vicinity of an associated corner of the marine platform 200 and extending generally vertically. In the figures, each strut 206 is secured to deck 204 with a strut deck bracket 207 and to marine platform 200 with a strut module bracket 208. The struts 206 may be any suitable type of shock absorber such as air shocks, MacPherson struts etc. Further, there need not be exactly four struts 206; more or fewer struts 206 may be suitable in some applications.

Some of the embodiments shown in the drawings include a roll-attenuation assembly 220 and/or a pitch-attenuation assembly 230. The roll-attenuation assembly 220 and the pitch-attenuation assembly 230 share functionally analogous components and for convenience and simplicity herein such functionally analogous components are given the same descriptive terms and reference numbers, though it will be understood that such components may differ in many respects, including size, as between the roll-attenuation assembly 220 and the pitch-attenuation assembly 230.

Each of the roll-attenuation assembly 220 and the pitch-attenuation assembly 230 includes a torsion bar 240, comprising: a longitudinally extending torsion spring 242 having at each end a torsion arm 244 or an adjustable torsion arm 246, extending laterally from the torsion spring 242. The torsion arm 244 has a torsion arm mounting hole 247 in the vicinity of the end of the torsion arm 244 opposite the torsion spring 242. The adjustable torsion arm 246 has a plurality of torsion arm mounting holes 247 in the vicinity of the end of the adjustable torsion arm 246 opposite the torsion spring 242.

A torsion arm link 248 or adjustable torsion arm link 250 is pivotally connected to each of the torsion arm 244 and adjustable torsion arm 246 at a respective torsion arm mounting hole 247. At the end of each torsion arm link 248 or adjustable torsion arm link 250 opposite the connection to the torsion arm 244 or adjustable torsion arm 246, as the case may be, there is a link bracket 252, that in use is mounted to the marine platform 200 or deck 204 or other appropriate component.

Along the torsion spring 242, there are two torsion-bar mounts 254 for mounting the torsion bar 240 to the marine platform 200 or deck 204 or other appropriate component. The torsion-bar mounts 254 tend to impede longitudinal movement of the torsion spring 242 while permitting rotational movement of the torsion spring 242.

In use, the roll-attenuation assembly 220 is mounted with the relevant torsion spring 242 extending athwart. In use, the pitch-attenuation assembly 230 is mounted with the relevant torsion spring 242 extending fore and aft.

The roll-attenuation assembly 220 and pitch-attenuation assembly 230 function along the lines of a conventional anti-sway bar in that the roll-attenuation assembly 220 and pitch-attenuation assembly 230 impede differential relative vertical movement between the two sets of components between which the two ends of the roll-attenuation assembly 220 and pitch-attenuation assembly 230 are interconnected. The degree to which the roll-attenuation assembly 220 and pitch-attenuation assembly 230 impede such relative vertical movement (i.e., the "stiffness" of the roll-attenuation assembly 220 and pitch-attenuation assembly 230) depends on the size and characteristics of the torsion spring 242; and the distance between the axis of rotation of the torsion spring 242 and the connection between the torsion arm 244 or adjustable torsion arm 246 and the torsion arm link 248 or adjustable torsion arm link 250 (as the case may be). Therefore, the "stiffness" of the roll-attenuation assembly 220 and pitch-attenuation assembly 230 may be adjusted by changing the torsion spring 242, and by moving the location of the connection between the adjustable torsion arm 246 and the torsion arm link 248 or adjustable torsion arm link 250 (as the case may be) by moving the connection to a different one of the plurality of torsion arm mounting holes 247 provided in the adjustable torsion arm 246.

The adjustable torsion arm 246 includes a bottlescrew 260 so as to permit adjustment of the length of the adjustable torsion arm 246.

Some of the embodiments shown in the drawings include spars 270, pivotally connected between the marine platform 200 and deck 204, by way of spar brackets 272, spar clevis brackets 274 or spar clevis lateral brackets 276.

In this specification, the term wishbone (e.g., forward wishbone 302 and aft wishbone 304) is used to refer to an assembly of two spars in which the two spars are fixed one to the other in the vicinity of the marine platform 200 and share a common pivotal attachment to the marine platform 200, being a wishbone platform bracket 312.

The spars 270 preferably have heim joints 314 (also referred to as rod end bearings and rose joints) at each end. The forward wishbone 302 and aft wishbone 304 preferably have heim joints 314 for the connection to the wishbone platform bracket 312. The heim joints 314 are preferably high-strength stainless steel heim joints.

Figures 2, 3, 4, 5, 6, 7, 8:
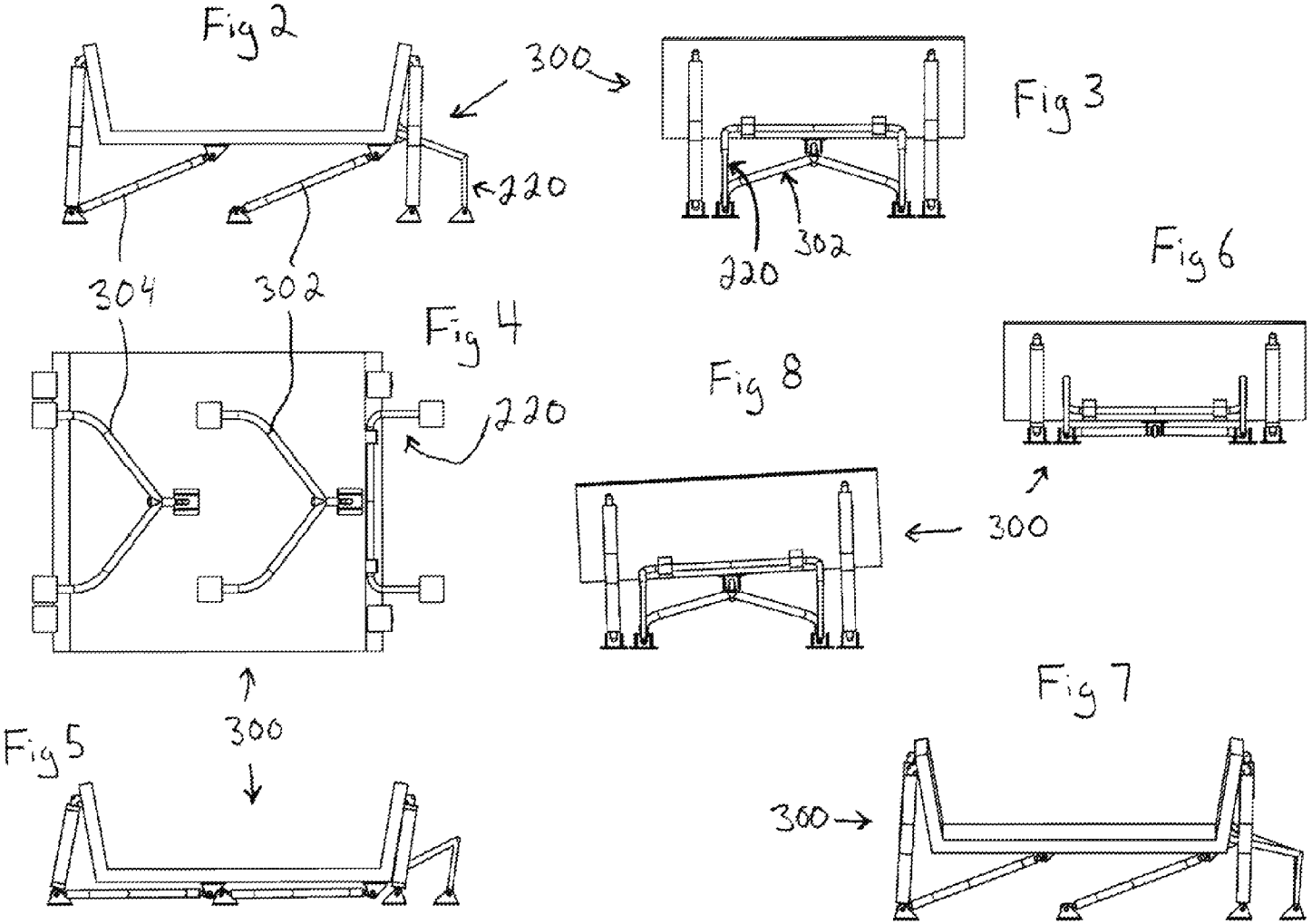
FIG. 2 is a starboard-side elevation view of the embodiment illustrated in FIG. 1, shown in the at-rest position.
FIG. 3 is a forward elevation view of the embodiment illustrated in FIG. 1, shown in the at-rest position.
FIG. 4 is a bottom plan view of the embodiment illustrated in FIG. 1, shown in the at-rest position.
FIG. 5 is a starboard-side elevation view of the embodiment illustrated in FIG. 1, shown in a compressed position.
FIG. 6 is a forward elevation view of the embodiment illustrated in FIG. 1, shown in a compressed position.
FIG. 7 is a starboard-side elevation view of the embodiment illustrated in FIG. 1, shown in a rolled-to-starboard position.
FIG. 8 is a forward elevation view of the embodiment illustrated in FIG. 1, shown in a rolled-to-starboard position.
Figure 9:
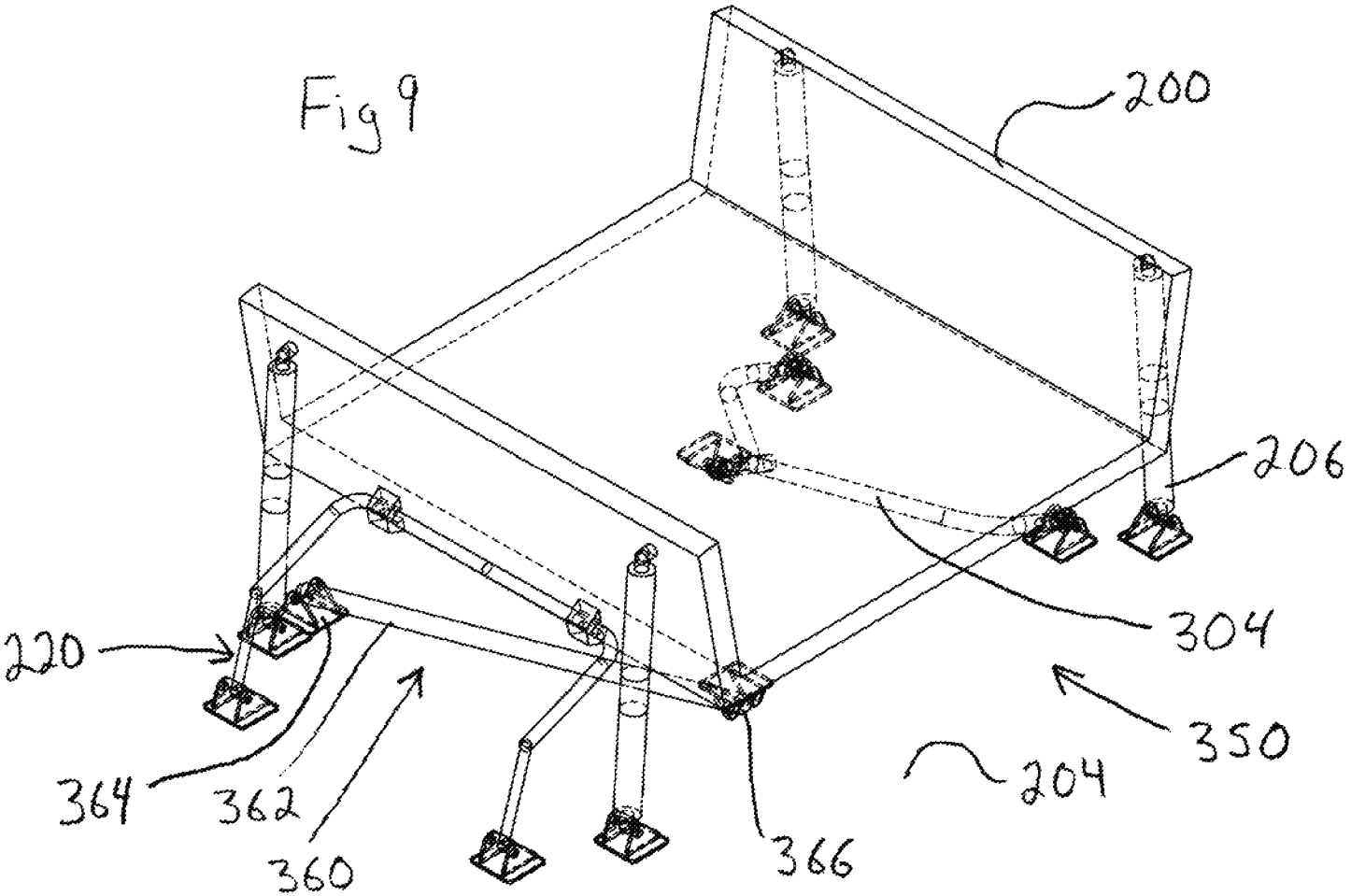
FIG. 9 is a forward-port-side isometric partially transparent view of a single-wishbone panhard anti-sway embodiment of the present invention, shown in the at-rest position.
Figure 11:
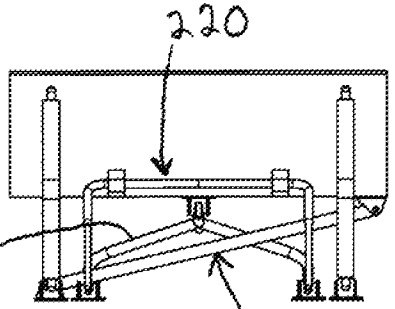
FIG. 11 is a forward elevation view of the embodiment illustrated in FIG. 9, shown in the at-rest position.
Figure 10:
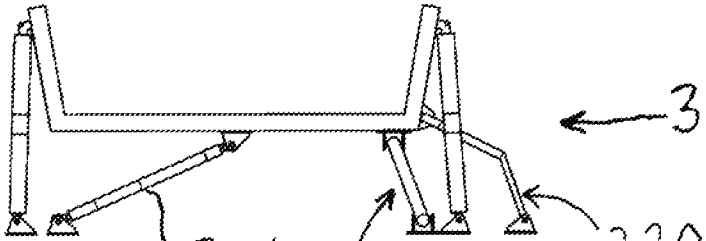
FIG. 10 is a starboard-side elevation view of the embodiment illustrated in FIG. 9, shown in the at-rest position.

Referring to FIGS. 1 through 8, there is illustrated an embodiment of the present invention comprising a marine platform 200 and an associated double-wishbone roll-attenuation suspension system, generally referenced by numeral 300, mounted to a deck 204. In FIGS. 1 through 4, the embodiment is shown with the marine platform 200 in a no-load at-rest position. In FIGS. 5 and 6, the embodiment is shown with the marine platform 200 in a compressed bottom position In FIGS. 7 and 8, the embodiment is shown with the marine platform 200 rolled to starboard relative to the deck 204.

In the embodiment shown in FIGS. 1 through 8, the double-wishbone roll-attenuation suspension system 300, includes four struts 206, a forward wishbone 302, an aft wishbone 304, and a roll-attenuation assembly 220.

As shown in the figures, each of the forward wishbone 302 and aft wishbone 304 is pivotally attached to the deck 204 with two wishbone deck brackets 310 and is pivotally attached to the marine platform 200 with a wishbone platform bracket 312. The heim joint 314 at the connection between each wishbone platform bracket 312 and the respective forward wishbone 302 and aft wishbone 304 permits some lateral pivotal movement so as to accommodate rolling of the marine platform 200 relative to the deck 204 when in use.

In use, fast-moving relatively small watercraft are subject to complicated threes that cause the vessels to pitch, yaw, roll, rise, fait, decelerate and accelerate. The response of the double-wishbone anti-sway suspension system 210 embodiment to such forces is indicated in FIGS. 5 through 8.

Figure 13:
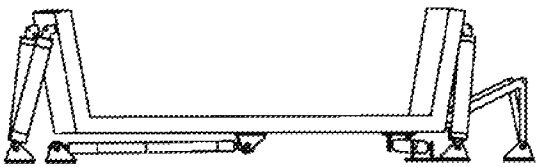
FIG. 13 is a starboard-side elevation view of the embodiment illustrated in FIG. 9, shown in a compressed position.
Figure 12:
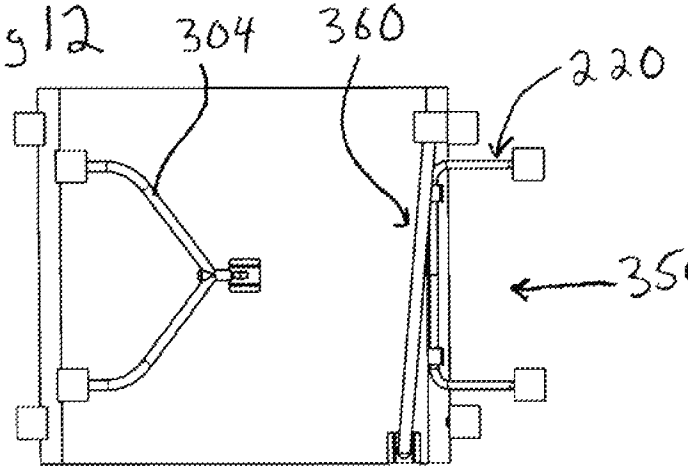
FIG. 12 is a bottom plan view of the embodiment illustrated in FIG. 9, shown in the at-rest position.
Figure 14:
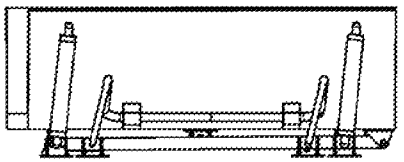
FIG. 14 is a forward elevation view of the embodiment illustrated in FIG. 9, shown in a compressed position.
Figure 17:
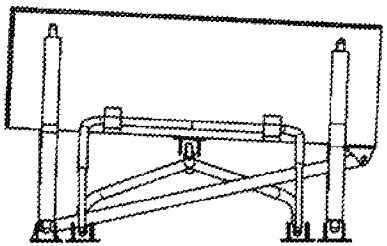
FIG. 17 is a forward elevation view of the embodiment illustrated in FIG. 9, shown in a rolled-to-port position.
Figure 15:
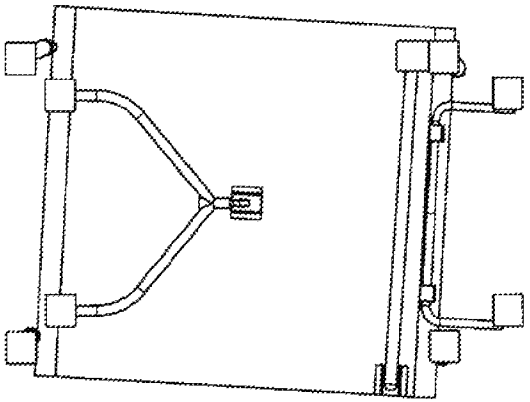
FIG. 15 is a bottom plan view of the embodiment illustrated in FIG. 9, shown in a compressed position.
Figure 16:
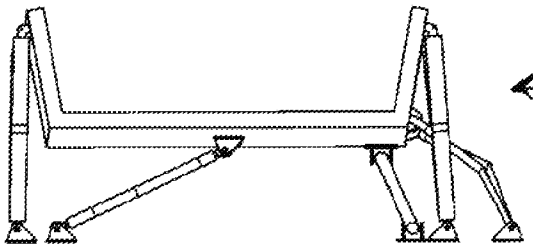
FIG. 16 is a starboard-side elevation view of the embodiment illustrated in FIG. 9, shown in a rolled-to-port position.

Referring to FIGS. 9 through 17, there is illustrated an embodiment of the present invention comprising a marine platform 200 and an associated single-wishbone panhard roll-attenuation suspension system, generally referenced by numeral 350, mounted to a deck 204. In FIGS. 9 through 12, the embodiment is shown with the marine platform 200 in a no-load at-rest position. In FIGS. 13 through 15, the embodiment is shown with the marine platform 200 in a compressed bottom position. In FIGS. 16 and 17, the embodiment is shown with the marine platform 200 rotted to port relative to the deck 204.

In the embodiment shown in FIGS. 9 through 17, the single-wishbone panhard roll-attenuation suspension system 350, includes four struts 206, an aft wishbone 304, a roll-attenuation assembly 220 and a panhard assembly 360. The aft wishbone 214 is configured and mounted as described above.

The panhard assembly 360 comprises a panhard rod 362, a panhard deck mount 364 and a panhard platform mount 366. The proximal end of the panhard rod 362 is pivotally mounted to the deck 204 with the panhard deck mount 364. The distal end of the panhard rod 362 is pivotally mounted to the marine platform 200 with the panhard platform mount 366.

In the embodiment shown in FIGS. 9 through 17, the panhard assembly 360 is positioned in the vicinity of the forward end of marine platform 200. The panhard assembly 360 prevents more than minimal lateral movement of marine platform 200 relative to deck 204. As the distal end of panhard rod 362 moves in an arc as marine platform 200 moves vertically relative to the deck 204, panhard rod 360 induces a slight lateral movement of marine platform 200 during vertical movement of marine platform 200. This slight lateral movement of marine platform 200 relative to deck 204 is accommodated generally by the various connections between the components of embodiment being configured to permit some relative lateral movement.

Figure 18:
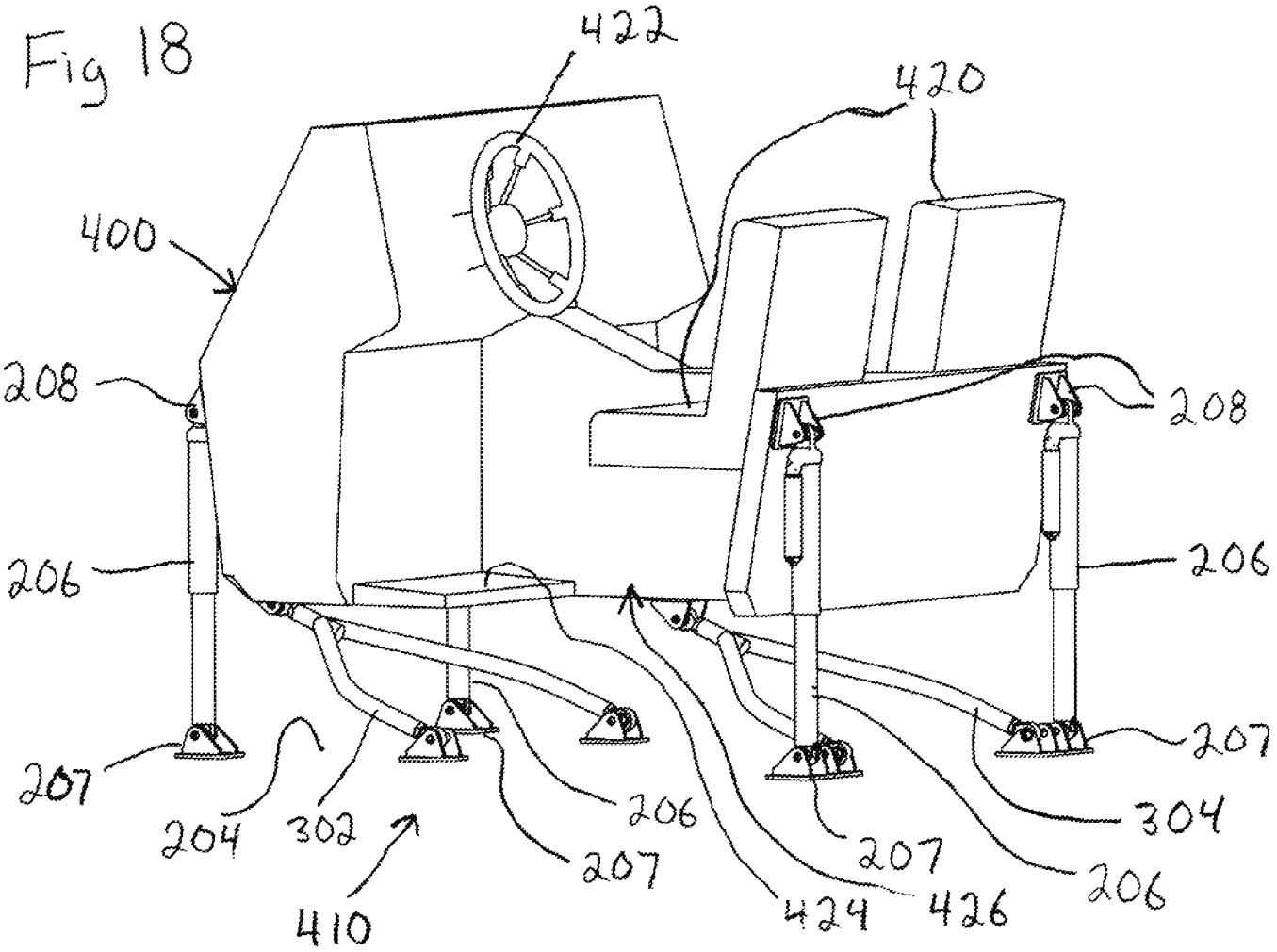
FIG. 18 is a rear-port-side isometric view of a control-module double-wishbone embodiment of the present invention, shown in the at-rest position.
Figure 19:
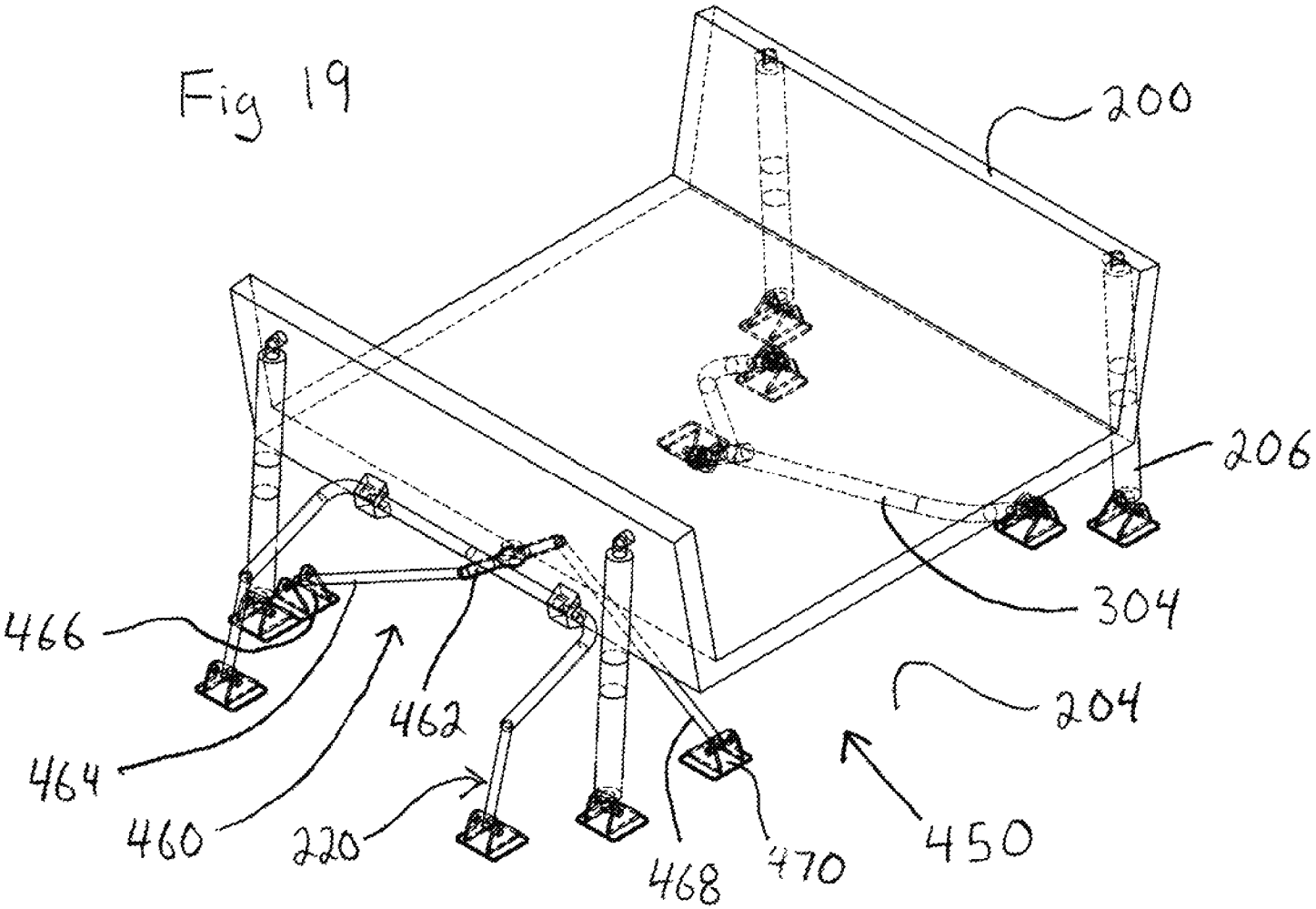
FIG. 19 is a forward-port-side isometric partially transparent view of a single-wishbone Watt's linkage anti-sway embodiment of the present invention, shown in the at-rest position.
Figure 21:
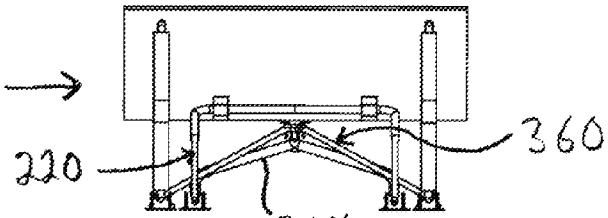
FIG. 21 is a forward elevation view of the embodiment illustrated in FIG. 19, shown in the at-rest position.

Referring to FIG. 18, there is illustrated an embodiment of the present invention comprising a control module 400, and a double-wishbone suspension system, generally referenced by numeral 410, mounted to a deck 204.

The control module 400 comprises two seats 420, a helm/control station 422, two foot rests 424 (one on the port side and the other on the starboard side; only one is visible in the drawing) and two foot openings 426 (again, one on the port side and the other on the starboard side; only one is visible in the drawing). The foot openings 426 permit users to selectively stand on the deck 204 or sit on the seats 420 while controlling the vessel or while being partially sheltered from spray by the control module 400.

In the embodiment shown in FIG. 18, the double-wishbone suspension system 410, includes four struts 206, a forward wishbone 302 and an aft wishbone 304.

Figure 23:
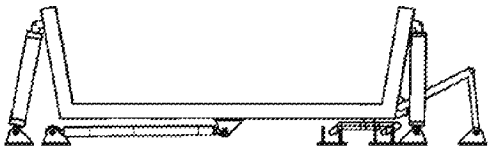
FIG. 23 is a starboard-side elevation view of the embodiment illustrated in FIG. 19, shown in a compressed position.
Figure 20:
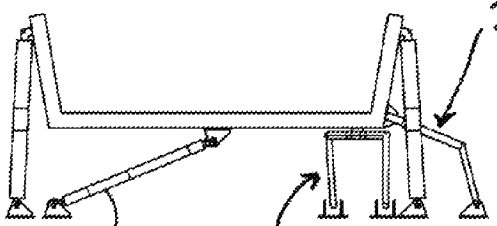
FIG. 20 is a starboard-side elevation view of the embodiment illustrated in FIG. 19, shown in the at-rest position.
Figure 22:
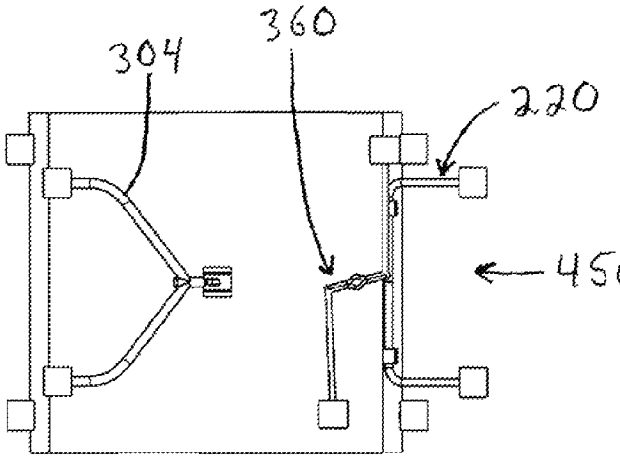
FIG. 22 is a bottom plan view of the embodiment illustrated in FIG. 19, shown in the at-rest position.
Figure 24:
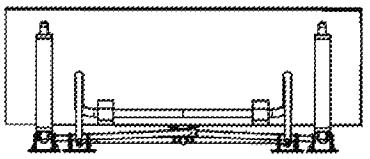
FIG. 24 is a forward elevation view of the embodiment illustrated in FIG. 19, shown in a compressed position.
Figure 25:
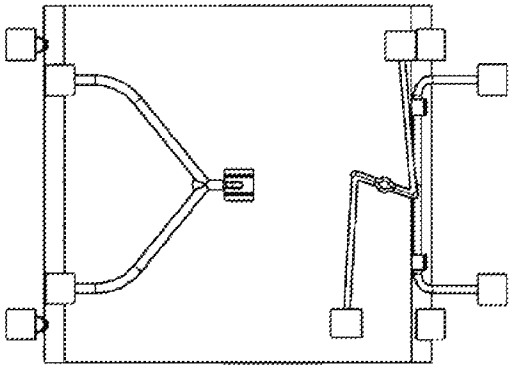
FIG. 25 is a bottom plan view of the embodiment illustrated in FIG. 19, shown in a compressed position.
Figure 27:
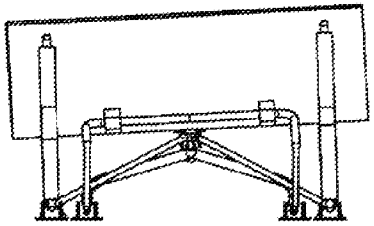
FIG. 27 is a forward elevation view of the embodiment illustrated in FIG. 19, shown in a rolled-to-starboard position.
Figure 26:
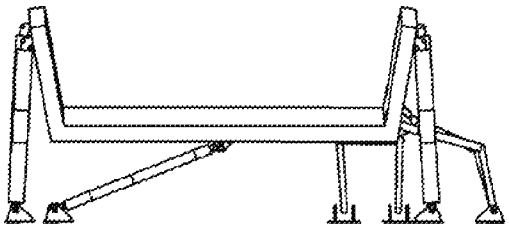
FIG. 26 is a starboard-side elevation view of the embodiment illustrated in FIG. 19, shown in a rolled-to-starboard position.
Figure 28:
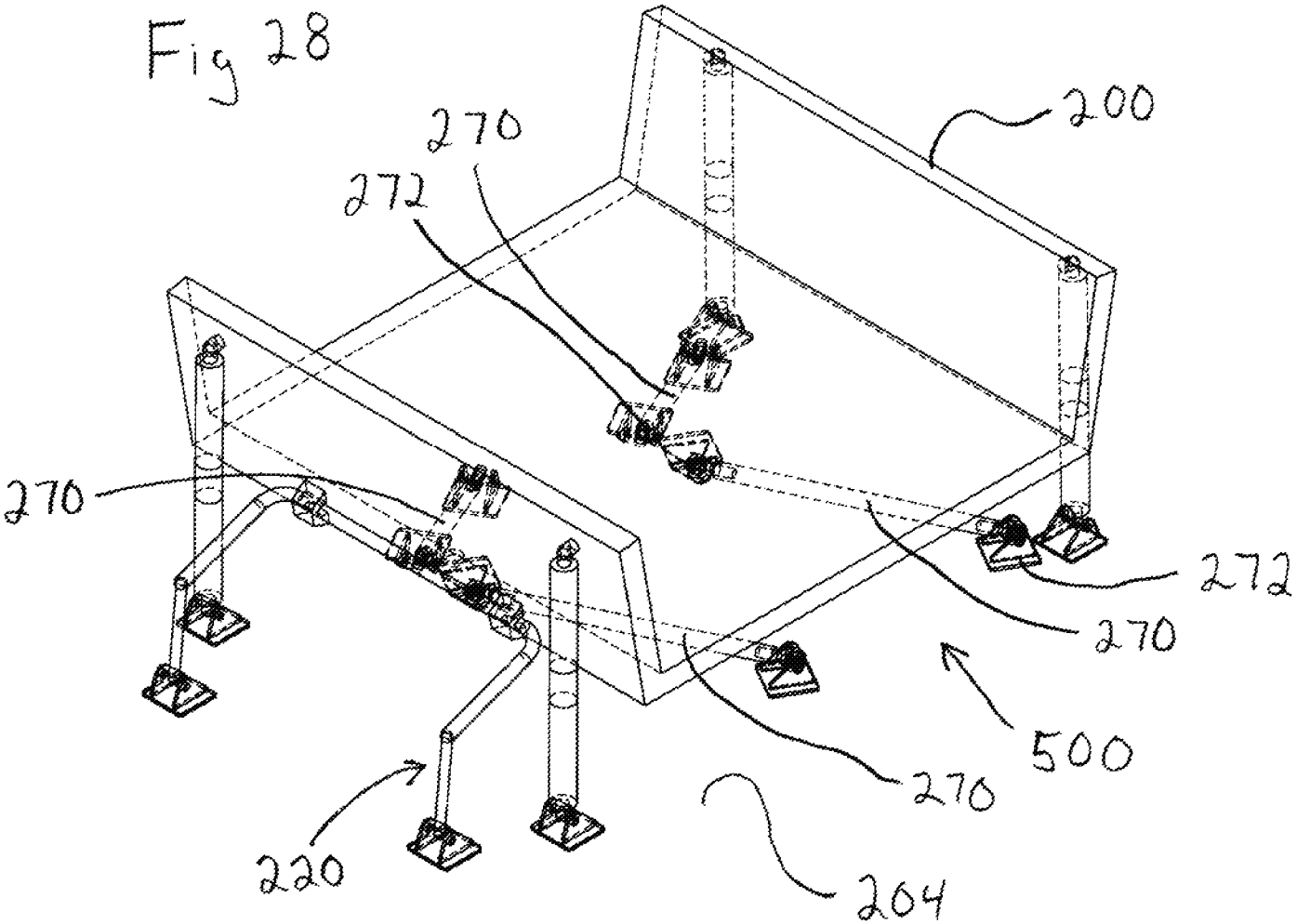
FIG. 28 is a forward-port-side isometric partially transparent view of a double two-spar roll-attenuation embodiment of the present invention, shown in the at-rest position.

Referring to FIGS. 19 through 27, there is illustrated an embodiment of the present invention comprising a marine platform 200 and an associated single-wishbone Watt's linkage roll-attenuation suspension system, generally referenced by numeral 450, mounted to a deck 204. In FIGS. 19 through 22, the embodiment is shown with the marine platform 200 in a no-load at-rest position. In FIGS. 23 through 25, the embodiment is shown with the marine platform 200 in a compressed bottom position. In FIGS. 26 and 27, the embodiment is shown with the marine platform 200 rolled to starboard relative to the deck 204.

In the embodiment shown in FIGS. 19 through 27, the single-wishbone Watt's linkage roll-attenuation suspension system 450, includes four struts 206, an aft wishbone 214, a roll-attenuation assembly 222 and a Watt's linkage 460.

The Watt's linkage 460 embodiment shown in the drawings comprises a Watt's link 462 rotatably mounted to the marine platform 200; a starboard Watt's rod 464 attached at one end to the Wads link 462 and attached at the other end to the deck 204 via a starboard Watt's rod deck mount 466; and a port Watts rod 468 attached at one end to the Wads link 462 (opposite the location of attachment of the starboard Watt's rod 464) and attached at the other end to the deck 204 via a port Watt's rod deck mount 470.

The Watt's linkage 460 permits vertical movement of the marine platform 200 relative to the deck 204, with minimal lateral movement of the marine platform 200 relative to the deck 204.

Figures 29, 30, 31, 32, 33, 34, 35:
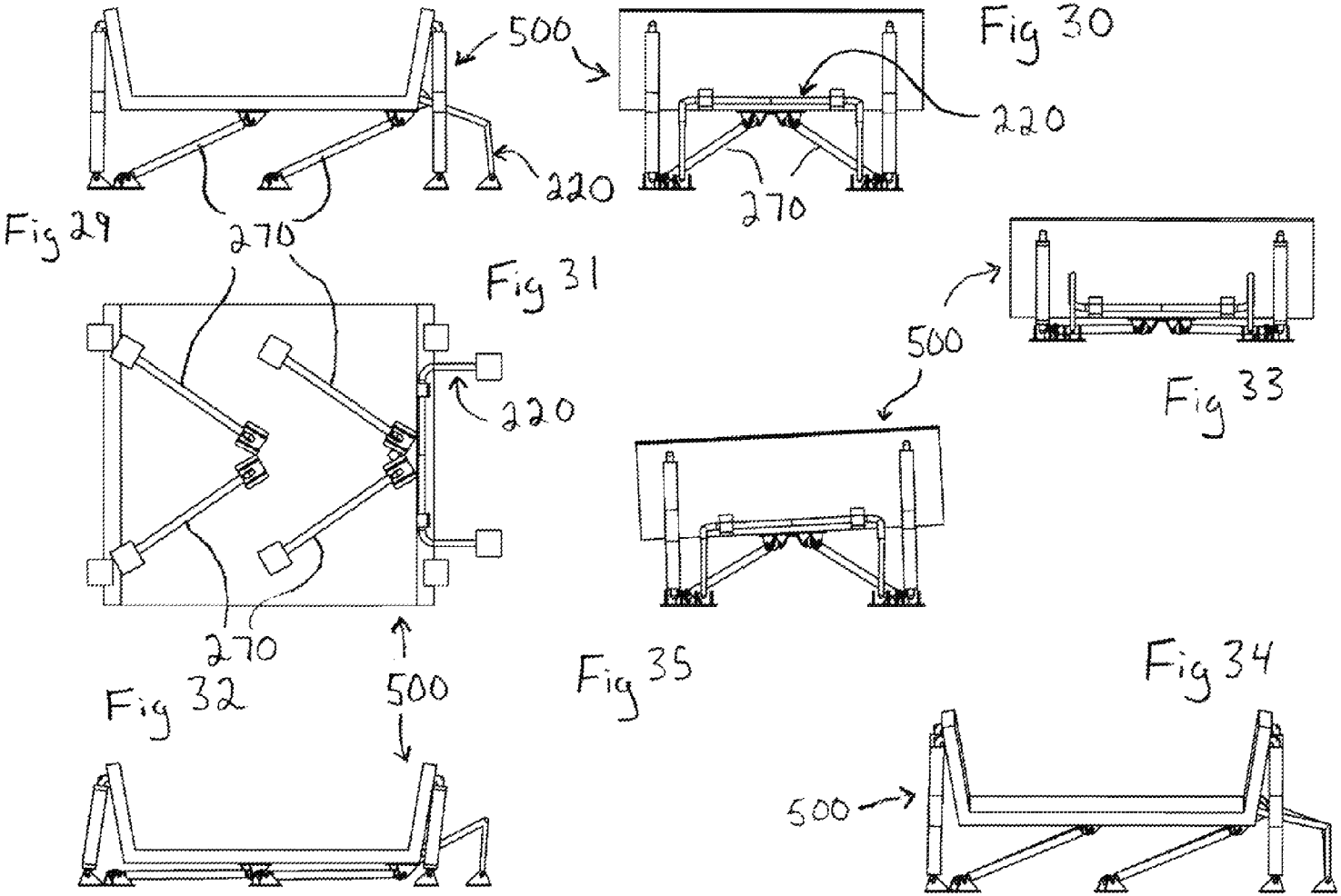
FIG. 29 is a starboard-side elevation view of the embodiment illustrated in FIG. 28, shown in the at-rest position.
FIG. 30 is a forward elevation view of the embodiment illustrated in FIG. 28, shown in the at-rest position.
FIG. 31 is a bottom plan view of the embodiment illustrated in FIG. 28, shown in the at-rest position.
FIG. 32 is a starboard-side elevation view of the embodiment illustrated in FIG. 28, shown in a compressed position.
FIG. 33 is a forward elevation view of the embodiment illustrated in FIG. 28, shown in a compressed position.
FIG. 34 is a starboard-side elevation view of the embodiment illustrated in FIG. 28, shown in a rolled-to-starboard position.
FIG. 35 is a forward elevation view of the embodiment illustrated in FIG. 28, shown in a rolled-to-starboard position.
Figure 36:
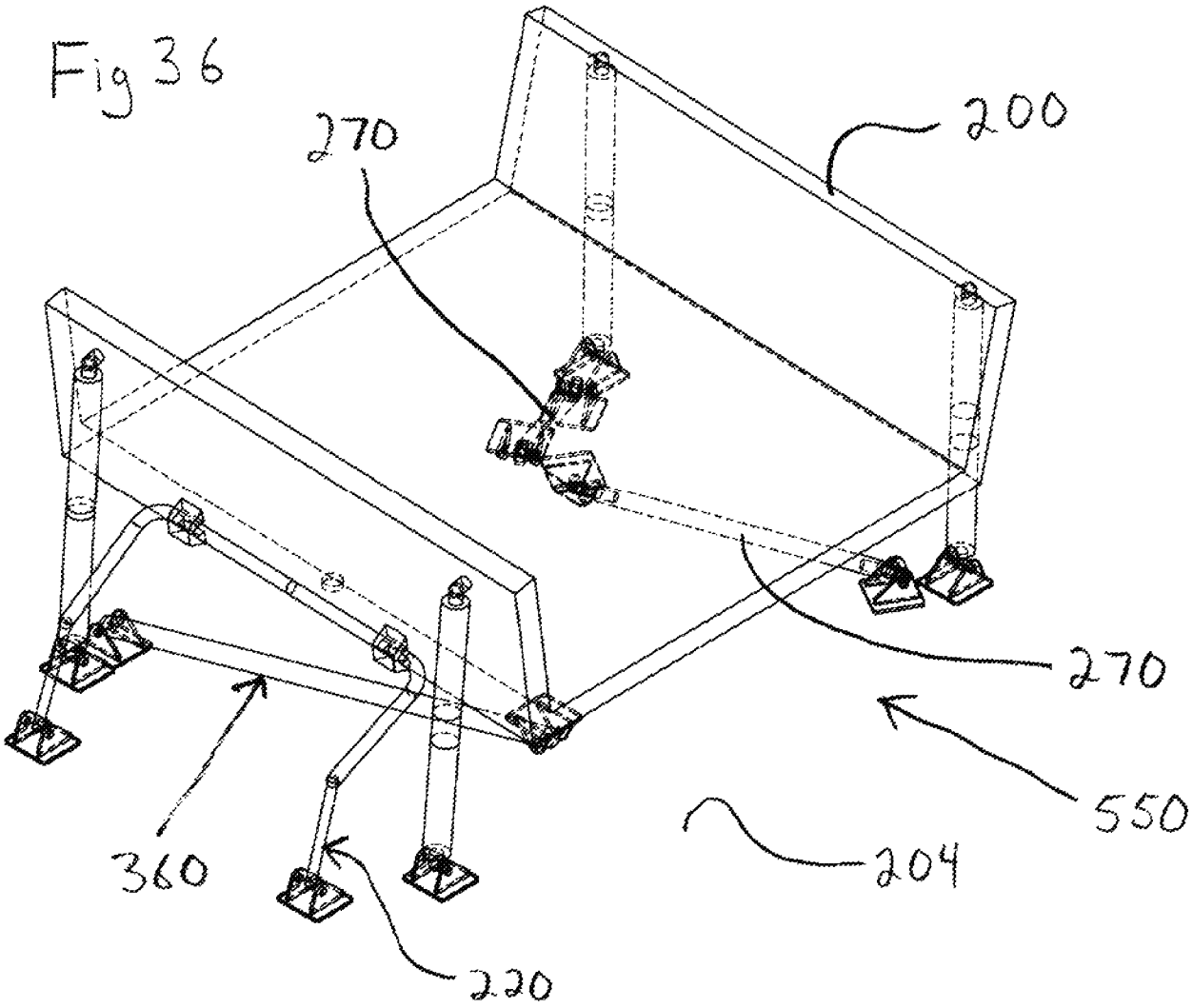
FIG. 36 is a forward-port-side isometric partially transparent view of a single two-spar panhard roll-attenuation embodiment of the present invention, shown in the at-rest position.
Figure 38:
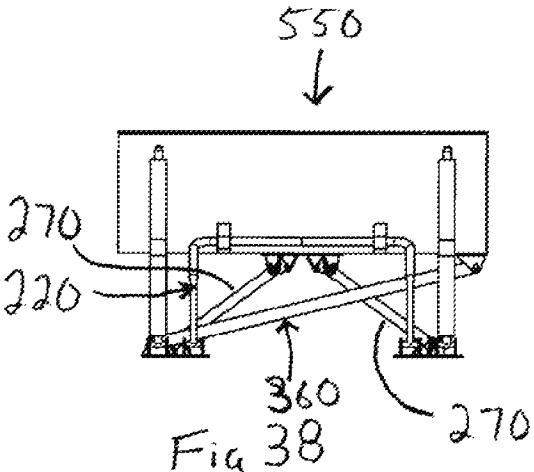
FIG. 38 is a forward elevation view of the embodiment illustrated in FIG. 36, shown in the at-rest position.

Referring to FIGS. 28 through 35, there is illustrated an embodiment of the present invention comprising a marine platform 200 and an associated double two-spar roll-attenuation suspension system, generally referenced by numeral 500, mounted to a deck 204. In FIGS. 28 through 31, the embodiment is shown with the marine platform 200 in a no-load at-rest position. In FIGS. 32 and 33, the embodiment is shown with the marine platform 200 in a compressed bottom position. In FIGS. 34 and 35, the embodiment is shown with the marine platform 200 rolled to starboard relative to the deck 204.

In the embodiment shown in FIGS. 28 through 35, the double two-spar roll-attenuation suspension system 500, includes four struts 206, a roll-attenuation assembly 220 and four spars 270. The spars 270 are arranged in two pairs, a forward pair and an aft pair, with each pair in the shape of a V, with the base of the V attached to the marine platform 200 and the top of the V attached to the deck 204.

Figure 40:
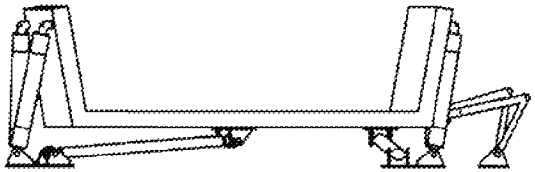
FIG. 40 is a starboard-side elevation view of the embodiment illustrated in FIG. 36, shown in a compressed position.
Figure 37:
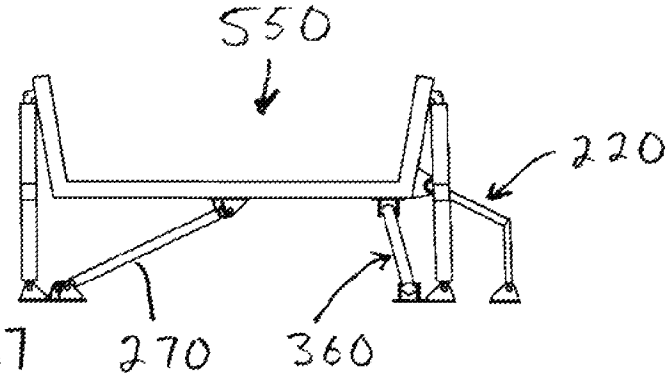
FIG. 37 is a starboard-side elevation view of the embodiment illustrated in FIG. 36, shown in the at-rest position.
Figure 39:
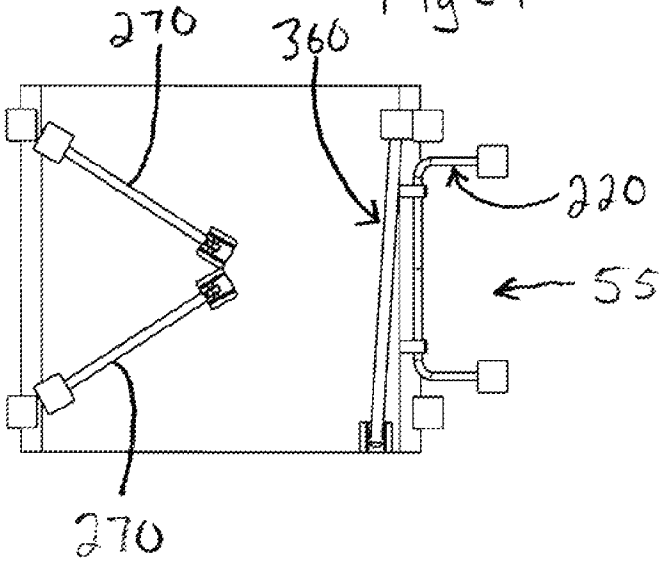
FIG. 39 is a bottom plan view of the embodiment illustrated in FIG. 36, shown in the at-rest position.
Figure 44:
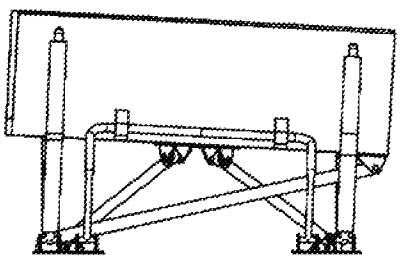
FIG. 44 is a forward elevation view of the embodiment illustrated in FIG. 36, shown in a rolled-to-starboard position.
Figure 43:
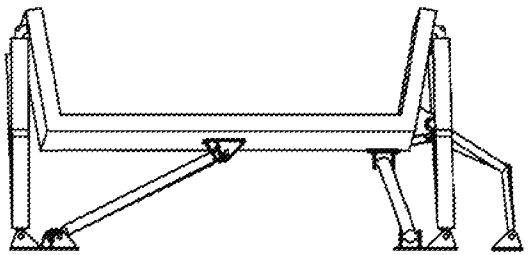
FIG. 43 is a starboard-side elevation view of the embodiment illustrated in FIG. 36, shown in a rolled-to-starboard position.
Figure 41:
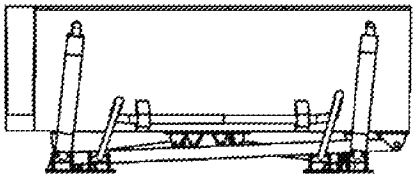
FIG. 41 is a forward elevation view of the embodiment illustrated in FIG. 36, shown in a compressed position.
Figure 42:
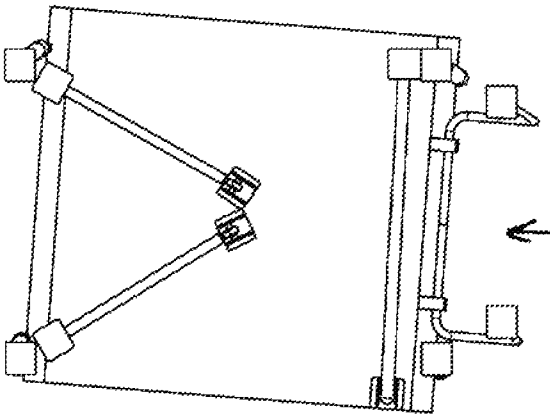
FIG. 42 is a bottom plan view of the embodiment illustrated in FIG. 36, shown in a compressed position.
Figure 45:
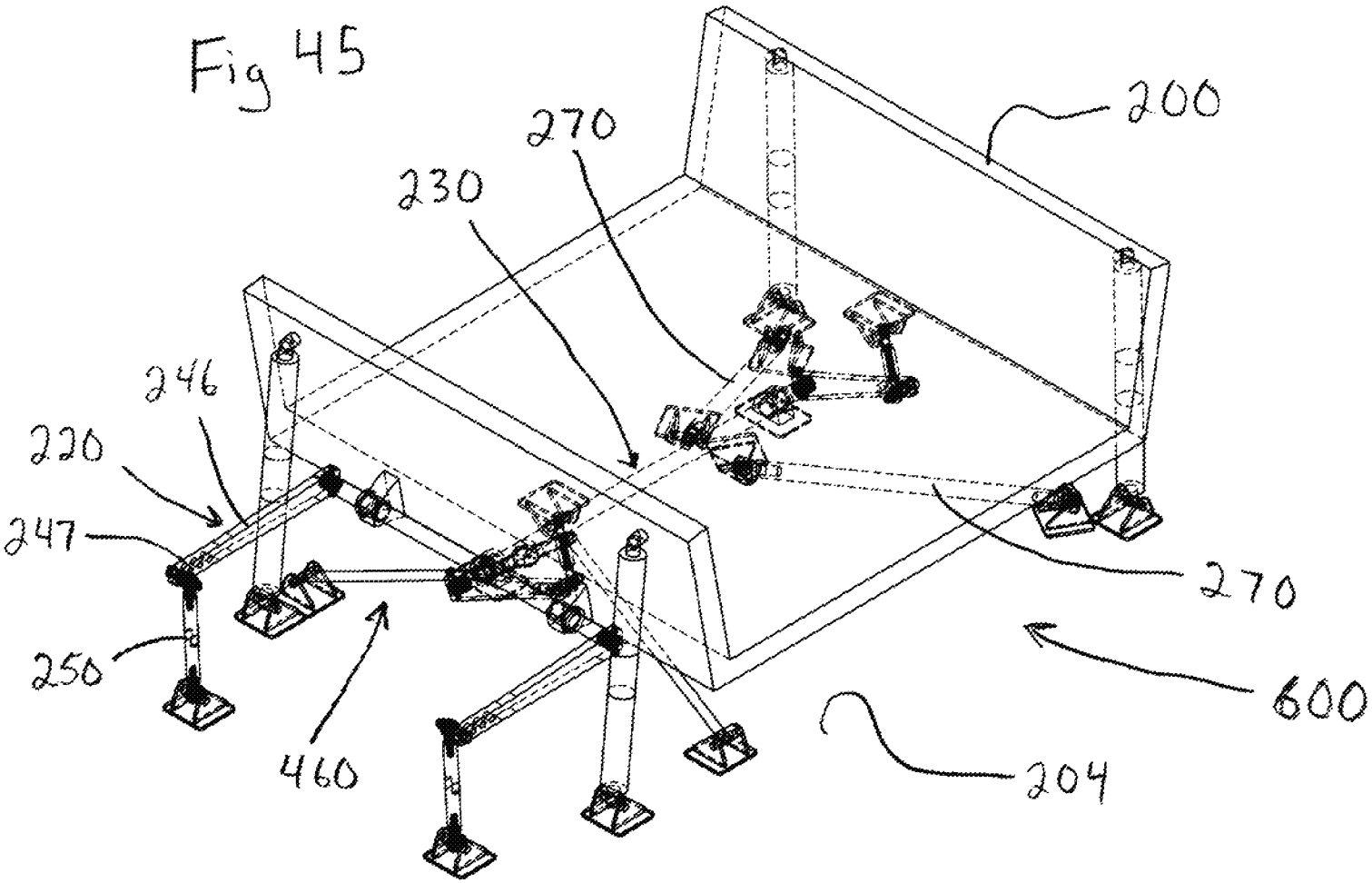
FIG. 45 is a forward-port-side isometric partially transparent view of a single two-spar Watt's linkage roll-attenuation pitch-attenuation embodiment of the present invention, shown in the at-rest position.
Figure 47:
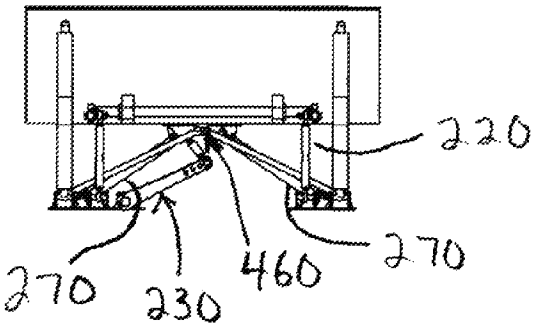
FIG. 47 is a forward elevation view of the embodiment illustrated in FIG. 45, shown in the at-rest position.

Referring to FIGS. 36 through 44, there is illustrated an embodiment of the present invention comprising a marine platform 200 and an associated single two-spar panhard roll-attenuation suspension system, generally referenced by numeral 550, mounted to a deck 204. In FIGS. 36 through 39, the embodiment is shown with the marine platform 200 in a no-load at-rest position. In FIGS. 40 through 42, the embodiment is shown with the marine platform 200 in a compressed bottom position. In FIGS. 43 and 44, the embodiment is shown with the marine platform 200 rolled to port relative to the deck 204.

In the embodiment shown in FIGS. 36 through 44, the single two-spar panhard roll-attenuation suspension system 550, includes four struts 206, a roll-attenuation assembly 220, a panhard assembly 360 and two spars 270. The spars 270 are arranged as a single aft pair, with the pair in the shape of a V, with the base of the V attached to the marine platform 200 and the top of the V attached to the deck 204.

Figure 49:
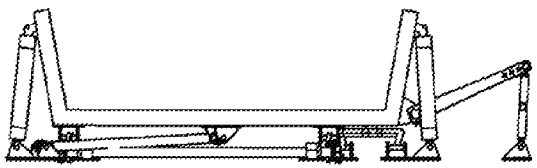
FIG. 49 is a starboard-side elevation view of the embodiment illustrated in FIG. 45, shown in a compressed position.
Figure 46:
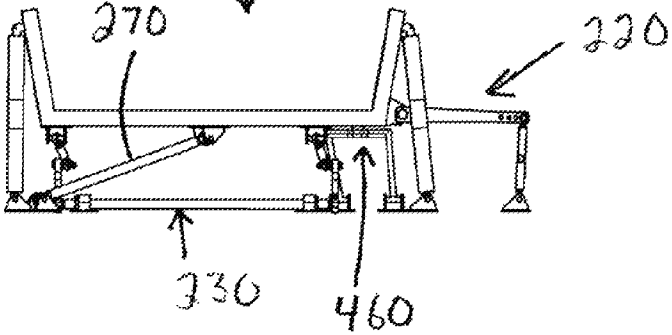
FIG. 46 is a starboard-side elevation view of the embodiment illustrated in FIG. 45, shown in the at-rest position.
Figure 48:
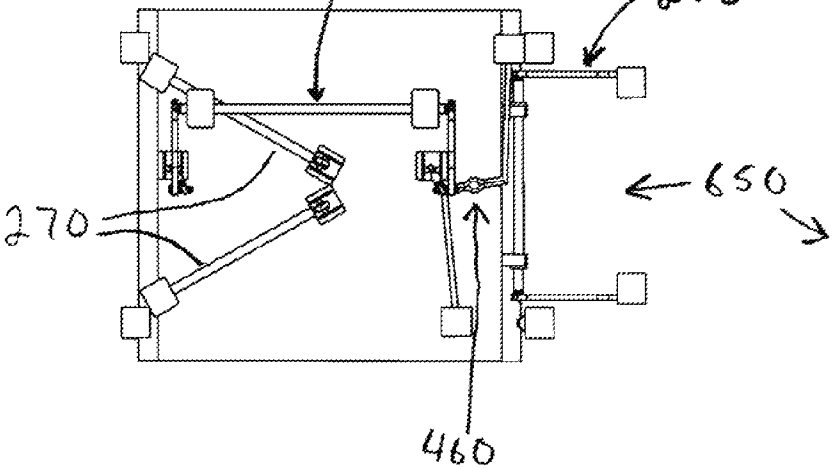
FIG. 48 is a bottom plan view of the embodiment illustrated in FIG. 45, shown in the at-rest position.
Figure 50:
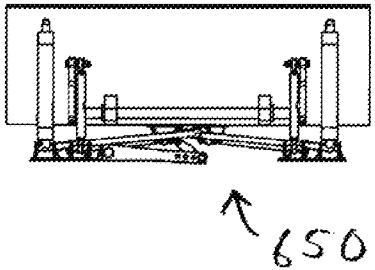
FIG. 50 is a forward elevation view of the embodiment illustrated in FIG. 45, shown in a compressed position.
Figure 53:
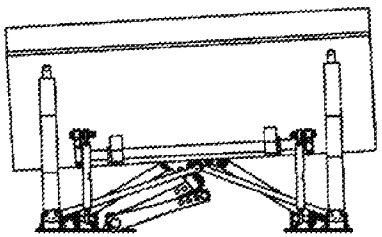
FIG. 53 is a forward elevation view of the embodiment illustrated in FIG. 45, shown in a rolled-to-starboard position.
Figure 51:
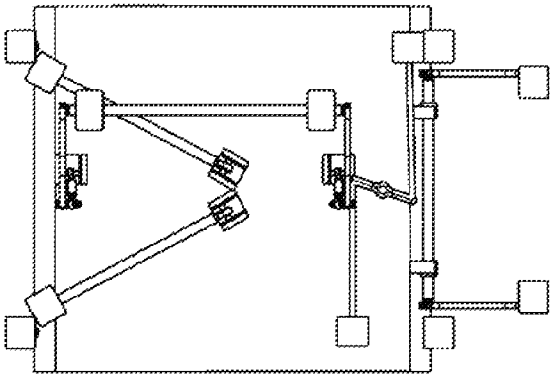
FIG. 51 is a bottom plan view of the embodiment illustrated in FIG. 45, shown in a compressed position.
Figure 52:
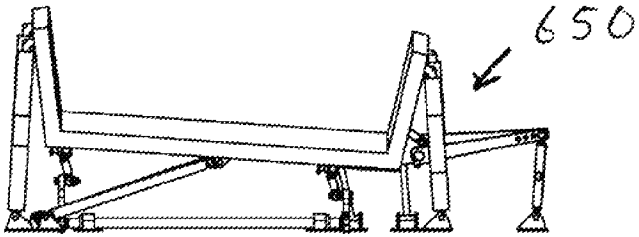
FIG. 52 is a starboard-side elevation view of the embodiment illustrated in FIG. 45, shown in a rolled-to-starboard position.

Referring to FIGS. 45 through 53, there is illustrated an embodiment of the present invention comprising a marine platform 200 and an associated single two-spar Watt's linkage roll-attenuation pitch-attenuation suspension system, generally referenced by numeral 600, mounted to a deck 204. In FIGS. 45 through 48, the embodiment is shown with the marine platform 200 in a no-load at-rest position. In FIGS. 49 through 51, the embodiment is shown with the marine platform 200 in a compressed bottom position. In FIGS. 52 and 53, the embodiment is shown with the marine platform 200 rolled to starboard relative to the deck 204.

In the embodiment shown in FIGS. 45 through 53, the single two-spar Watt's linkage roll-attenuation pitch-attenuation suspension system 600, includes four struts 206, a roll-attenuation assembly 220, a pitch-attenuation assembly 230, a Watt's linkage 460 and two spars 270. The spars 270 are arranged as a single aft pair, with the pair in the shape of a V, with the base of the V attached to the marine platform 200 and the top of the V attached to the deck 204.

Figure 54:
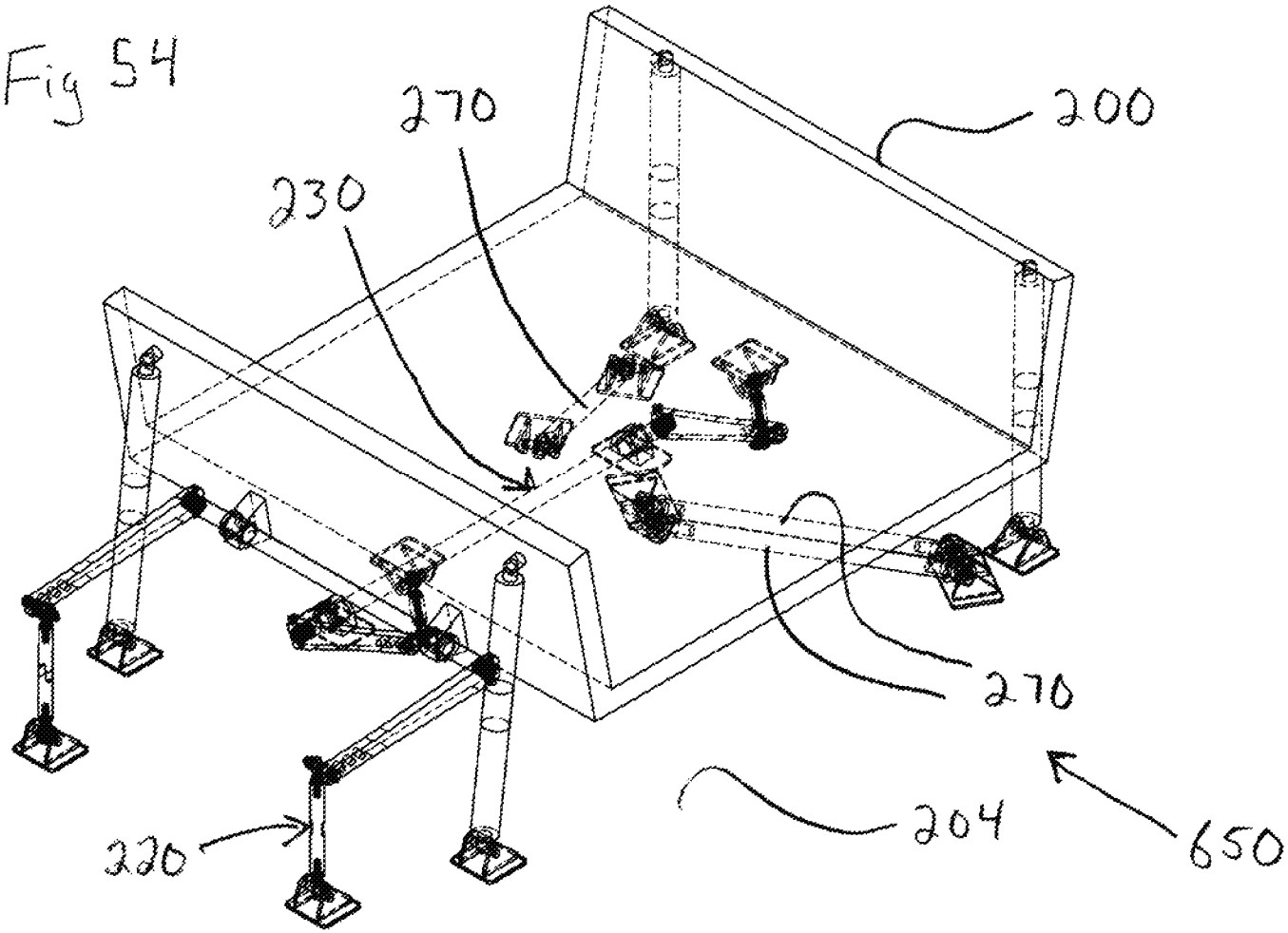
FIG. 54 is a forward-port-side isometric partially transparent view of a single one-spar-two-spar roll-attenuation pitch-attenuation embodiment of the present invention, shown in the at-rest position.
Figures 55, 56, 57, 58, 59, 60:
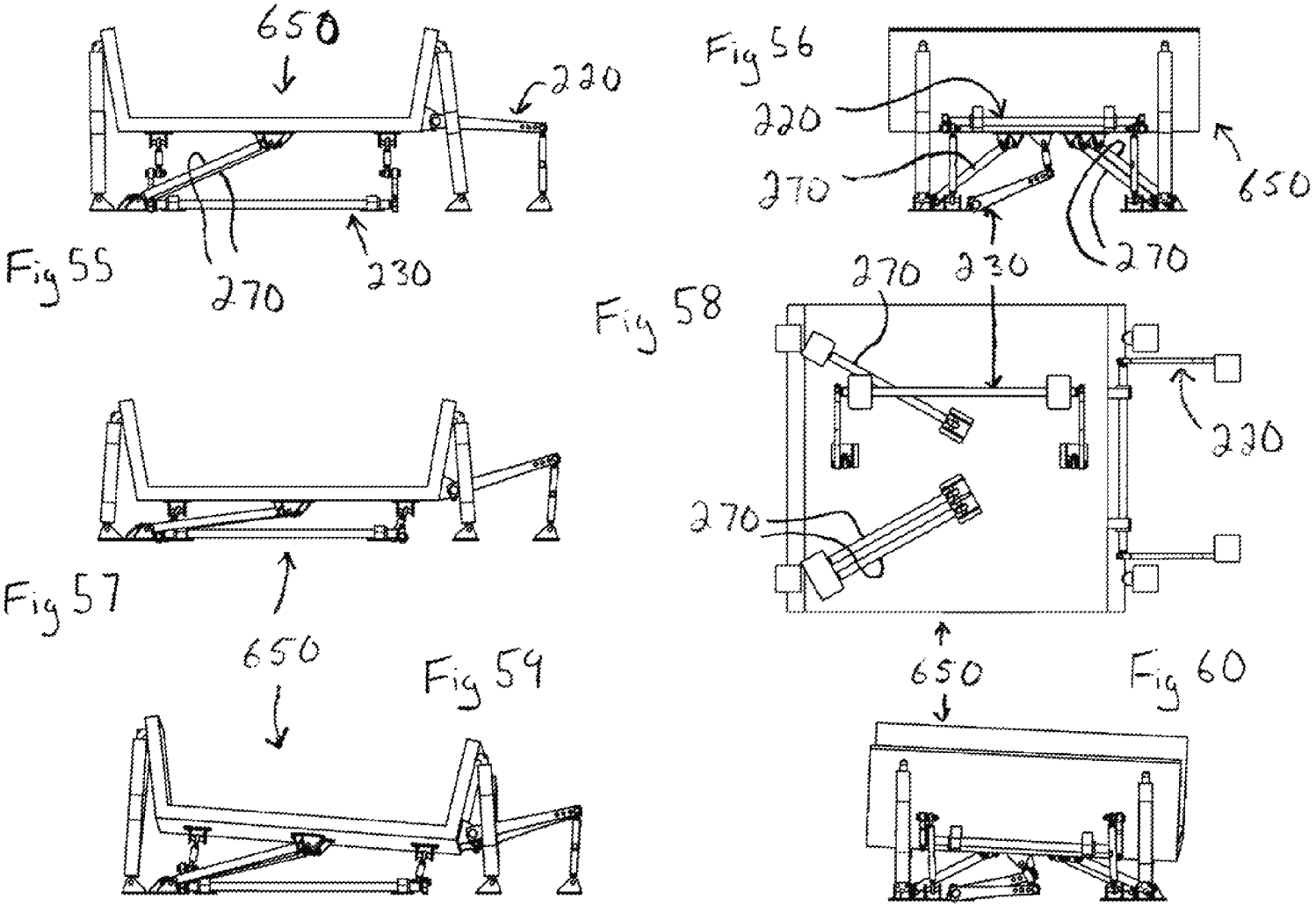
FIG. 55 is a starboard-side elevation view of the embodiment illustrated in FIG. 54, shown in the at-rest position.
FIG. 56 is a forward elevation view of the embodiment illustrated in FIG. 54, shown in the at-rest position.
FIG. 57 is a starboard-side elevation view of the embodiment illustrated in FIG. 54, shown in a compressed position.
FIG. 58 is a bottom plan view of the embodiment illustrated in FIG. 54, shown in a compressed position.
FIG. 59 is a starboard-side elevation view of the embodiment illustrated in FIG. 54, shown in a rolled-to-port position.
FIG. 60 is a forward elevation view of the embodiment illustrated in FIG. 54, shown in a rolled-to-port position.

Referring to FIGS. 54 through 60, there is illustrated an embodiment of the present invention comprising a marine platform 200 and an associated single one-spar-two-spar roll-attenuation pitch-attenuation suspension system, generally referenced by numeral 650, mounted to a deck 204. In FIGS. 54 through 56, the embodiment is shown with the marine platform 200 in a no-load at-rest position. In FIGS. 57 and 58, the embodiment is shown with the marine platform 200 in a compressed position. In FIGS. 59 and 60, the embodiment is shown with the marine platform 200 rolled to port and with forward-end-down pitch, both relative to the deck 204.

In the embodiment shown in FIGS. 54 through 60, the single one-spar-two-spar roll-attenuation pitch-attenuation suspension system 650, includes four struts 206, a roll-attenuation assembly 220, a pitch-attenuation assembly 230, and three spars 270. The three spars 270 are arranged in the shape of a V, with two of the spars 270 adjacent and parallel to each other, and defining one side of the V, and the third spar 270 defining the other side of the V; and with the base of the V attached to the marine platform 200 and the top of the V attached to the deck 204.

Figure 61:
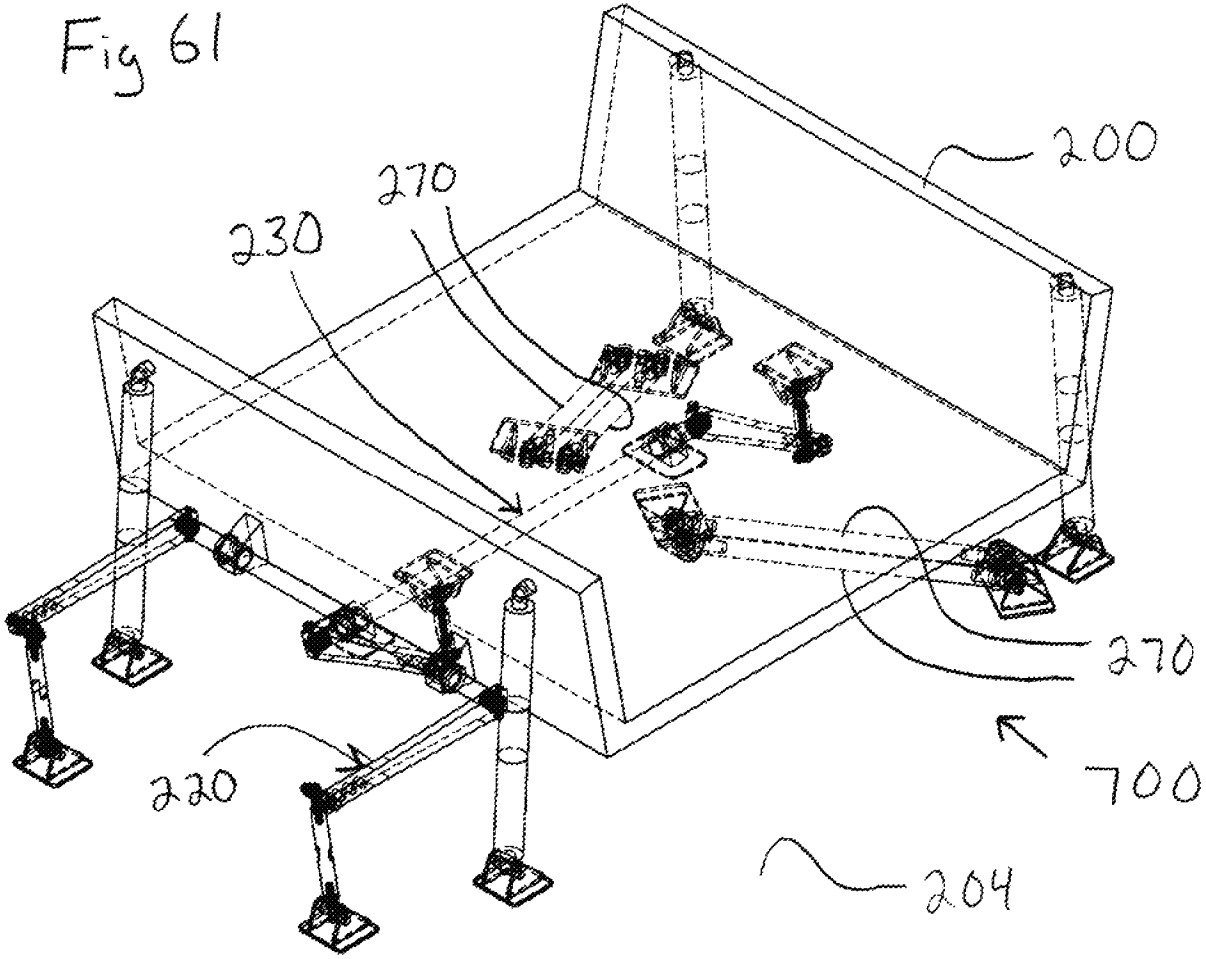
FIG. 61 is a forward-port-side isometric partially transparent view of a single two-spar-two-spar roll-attenuation pitch-attenuation embodiment of the present invention, shown in the at-rest position.
Figures 62, 63, 64, 65, 66, 67:
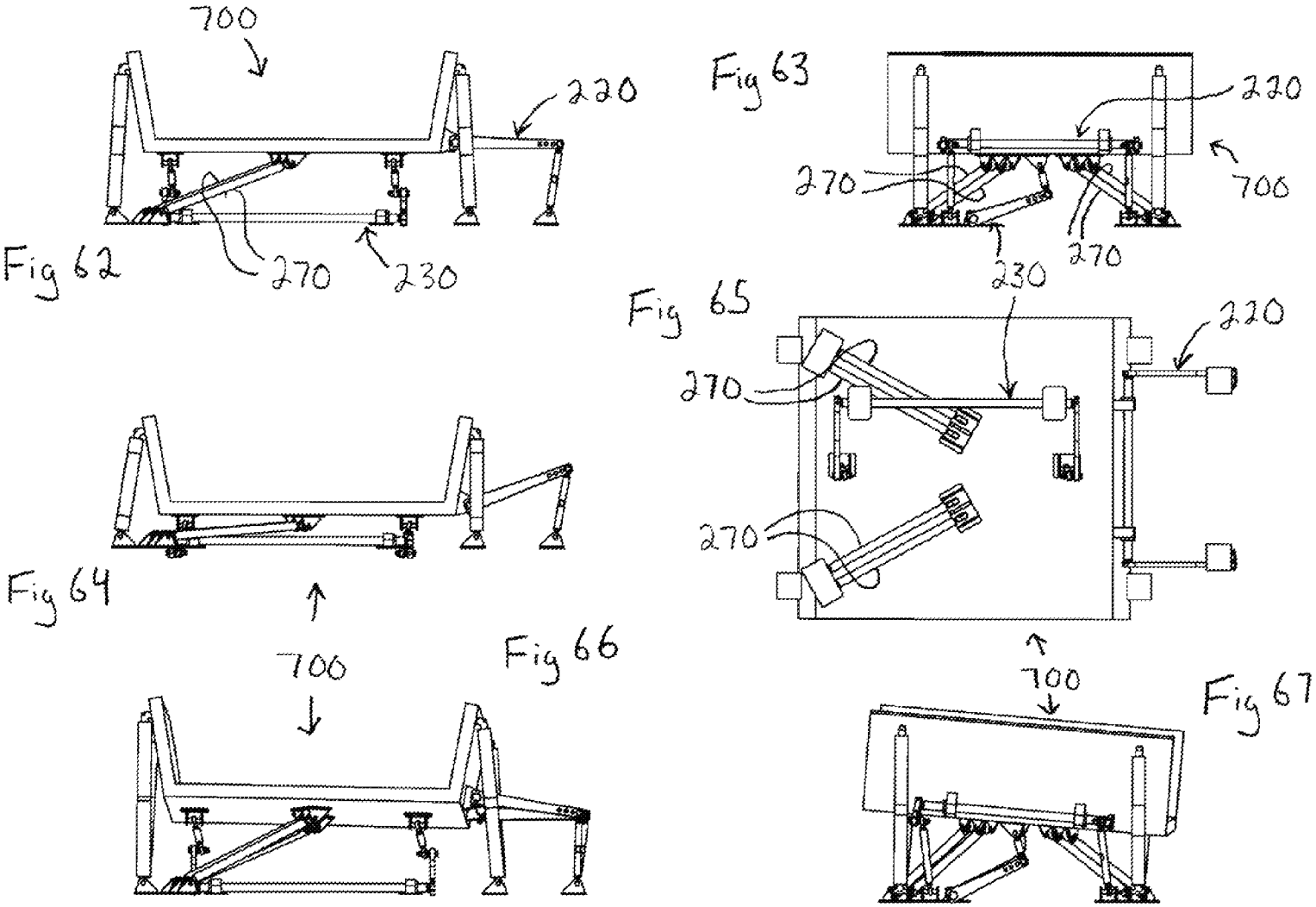
FIG. 62 is a starboard-side elevation view of the embodiment illustrated in FIG. 61, shown in the at-rest position.
FIG. 63 is a forward elevation view of the embodiment illustrated in FIG. 61, shown in the at-rest position.
FIG. 64 is a starboard-side elevation view of the embodiment illustrated in FIG. 61, shown in a compressed position.
FIG. 65 is a bottom plan view of the embodiment illustrated in FIG. 61, shown in a compressed position.
FIG. 66 is a starboard-side elevation view of the embodiment illustrated in FIG. 61, shown in a rolled-to-port position.
FIG. 67 is a forward elevation view of the embodiment illustrated in FIG. 61, shown in a rolled-to-port position.

Referring to FIGS. 61 through 67, there is illustrated an embodiment of the present invention comprising a marine platform 200 and an associated single two-spar-two-spar roll-attenuation pitch-attenuation suspension system, generally referenced by numeral 700, mounted to a deck 204. In FIGS. 61 through 63, the embodiment is shown with the marine platform 200 in a no-load at-rest position. In FIGS. 64 and 65, the embodiment is shown with the marine platform 200 in a compressed position. In FIGS. 66 and 67, the embodiment is shown with the marine platform 200 rolled to port relative to the deck 204.

In the embodiment shown in FIGS. 61 through 67, the single two-spar-two-spar roll-attenuation pitch-attenuation suspension system 700, includes four struts 206, a roll-attenuation assembly 220, a pitch-attenuation assembly 230, and four spars 270. The four spars 270 are arranged in the shape of a V, with two of the spars 270 adjacent and parallel to each other, and defining one side of the V, and the other two of the spars 270 adjacent and parallel to each other, and defining the other side of the V; and with the base of the V attached to the marine platform 200 and the top of the V attached to the deck 204.

Figure 68:
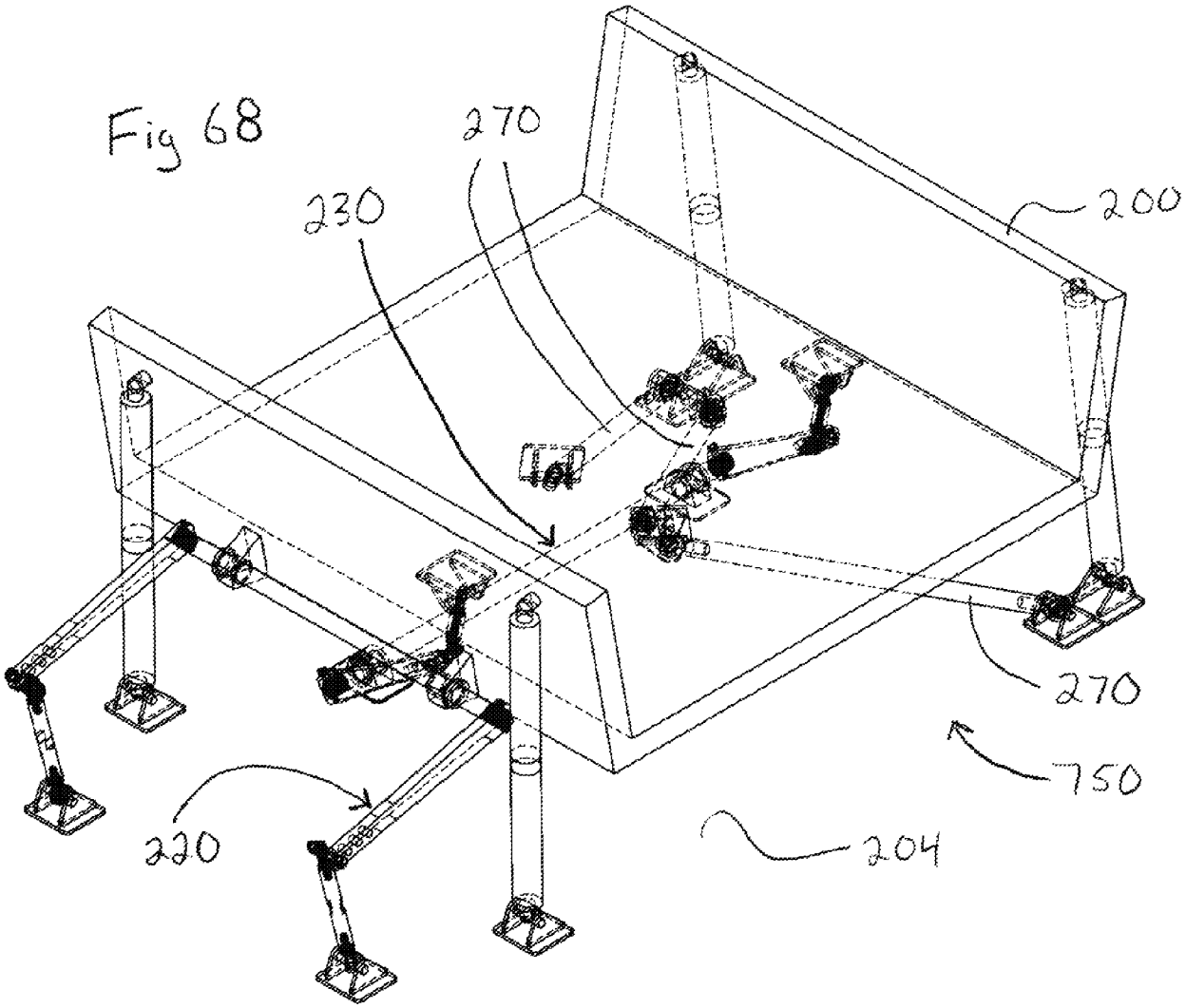
FIG. 68 is a forward-port-side isometric partially transparent view of a single three-spar anti-sway anti-pitch clevis-mount embodiment of the present invention, shown in the at-rest position.
Figures 69, 70, 71, 72, 73, 74:
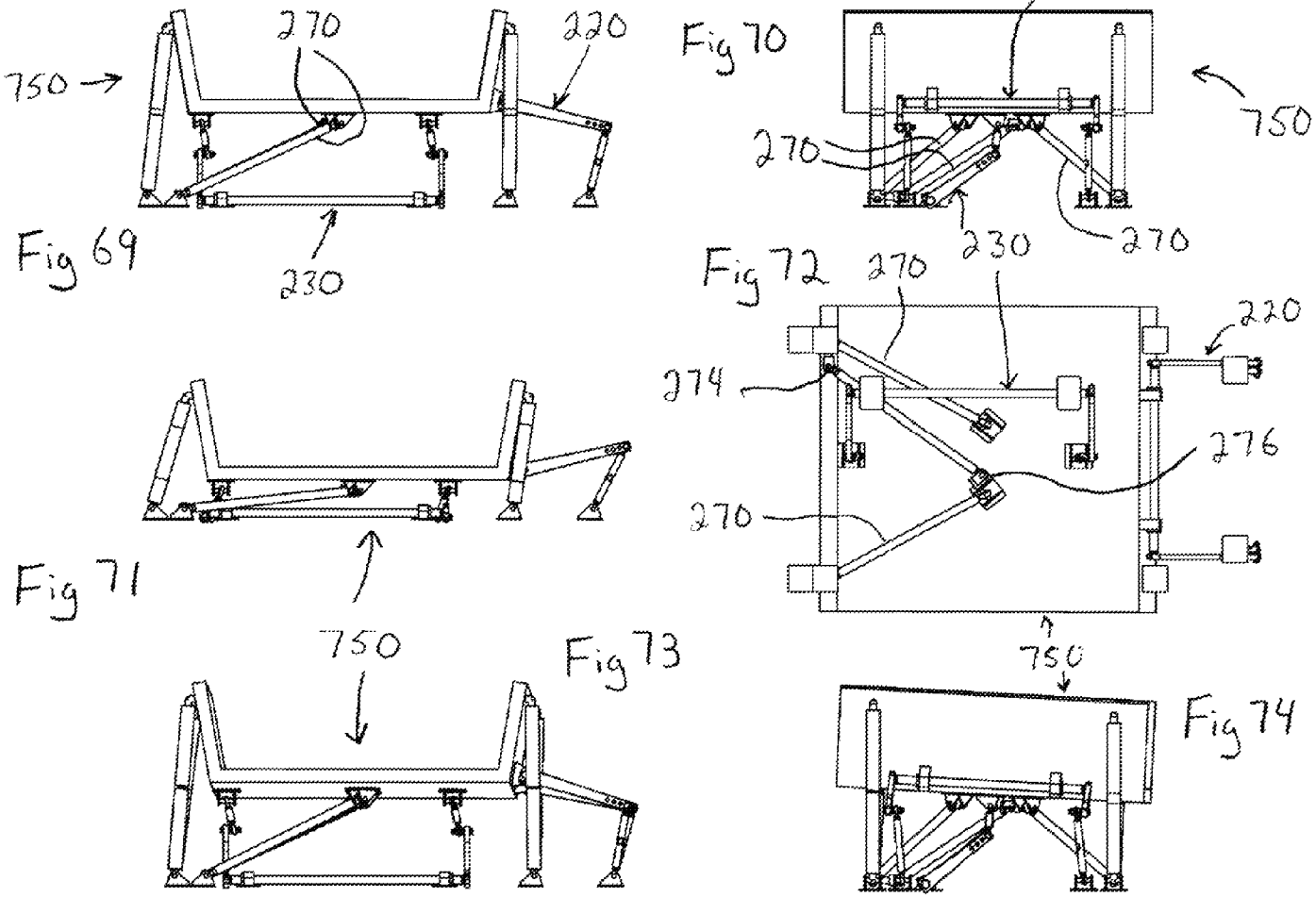
FIG. 69 is a starboard-side elevation view of the embodiment illustrated in FIG. 68, shown in the at-rest position.
FIG. 70 is a forward elevation view of the embodiment illustrated in FIG. 68, shown in the at-rest position.
FIG. 71 is a starboard-side elevation view of the embodiment illustrated in FIG. 68, shown in a compressed position.
FIG. 72 is a bottom plan view of the embodiment illustrated in FIG. 68, shown in a compressed position.
FIG. 73 is a starboard-side elevation view of the embodiment illustrated in FIG. 68, shown in a rolled-to-port position.
FIG. 74 is a forward elevation view of the embodiment illustrated in FIG. 68, shown in a rolled-to-port position.

Referring to FIGS. 68 through 74, there is illustrated an embodiment of the present invention comprising a marine platform 200 and an associated single three-spar-splayed roll-attenuation pitch-attenuation clevis-mount suspension system, generally referenced by numeral 750, mounted to a deck 204. In FIGS. 68 through 70, the embodiment is shown with the marine platform 200 in a no-load at-rest position. In FIGS. 71 and 72, the embodiment is shown with the marine platform 200 in a compressed position. In FIGS. 73 and 74, the embodiment is shown with the marine platform 200 rolled to port relative to the deck 204.

In the embodiment shown in FIGS. 68 through 74, the single three-spar-splayed roll-attenuation pitch-attenuation clevis-mount suspension system 750, includes four struts 206, a roll-attenuation assembly 220, a pitch-attenuation assembly 230, and three spars 270. The three spars 270 are generally splayed in that the spars 270 diverge in that the ends of the spars 270 mounted to the marine platform are closer one to the other than the ends of the spars 270 mounted to the deck 204.

As indicated most clearly in FIG. 72, in the single three-spar-splayed roll-attenuation pitch-attenuation clevis-mount suspension system 750, the middle spar 270 and starboard-side spar 270 are mounted to the deck 204 with a spar clevis bracket 274; and the middle spar 270 and port-side spar 270 are mounted to the marine platform 200 with a spar clevis lateral bracket 276.

Figure 75:
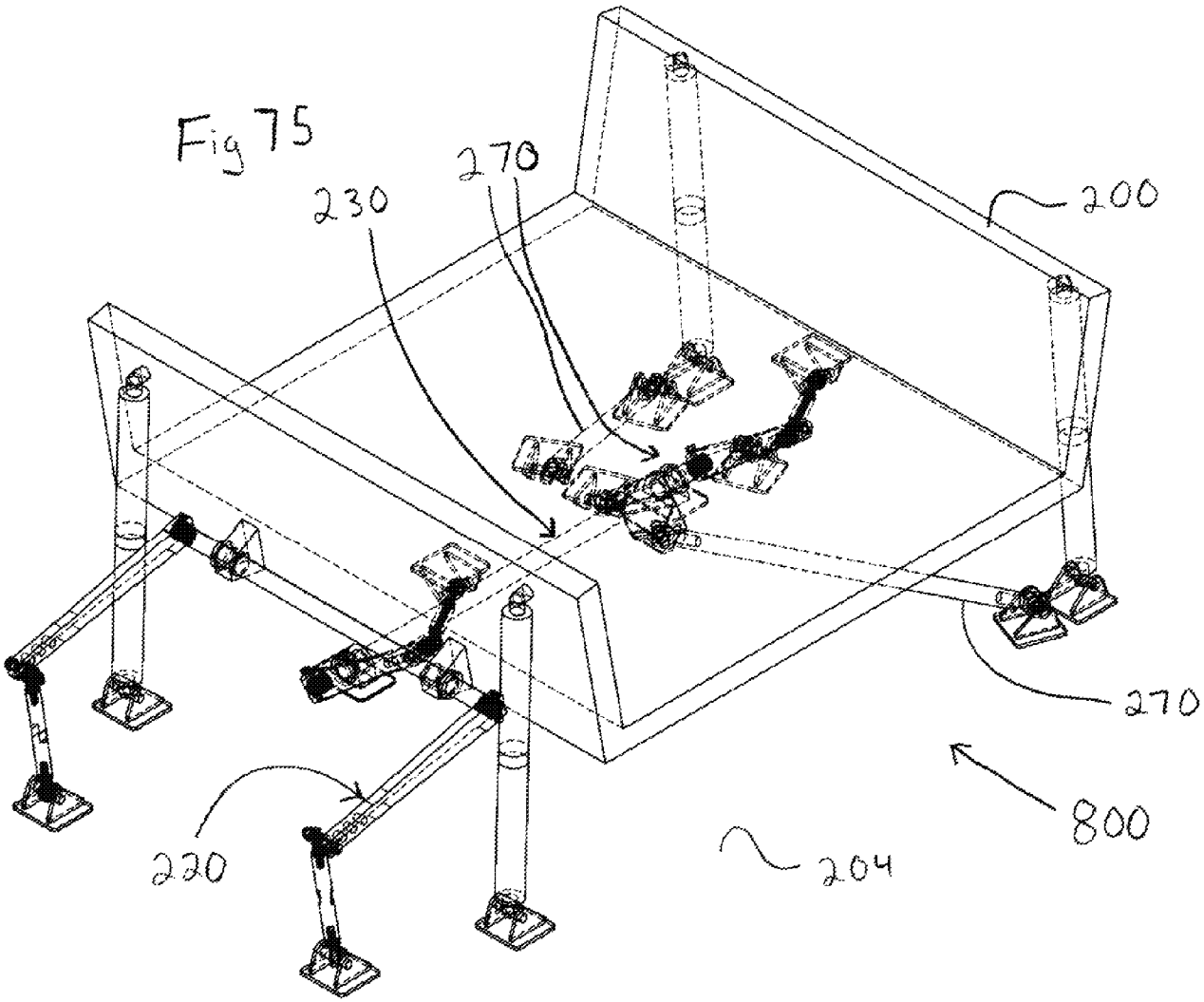
FIG. 75 is a forward-port-side isometric partially transparent view of a single three-spar roll-attenuation pitch-attenuation embodiment of the present invention, shown in the at-rest position.
Figures 76, 77, 78, 79, 80, 81:
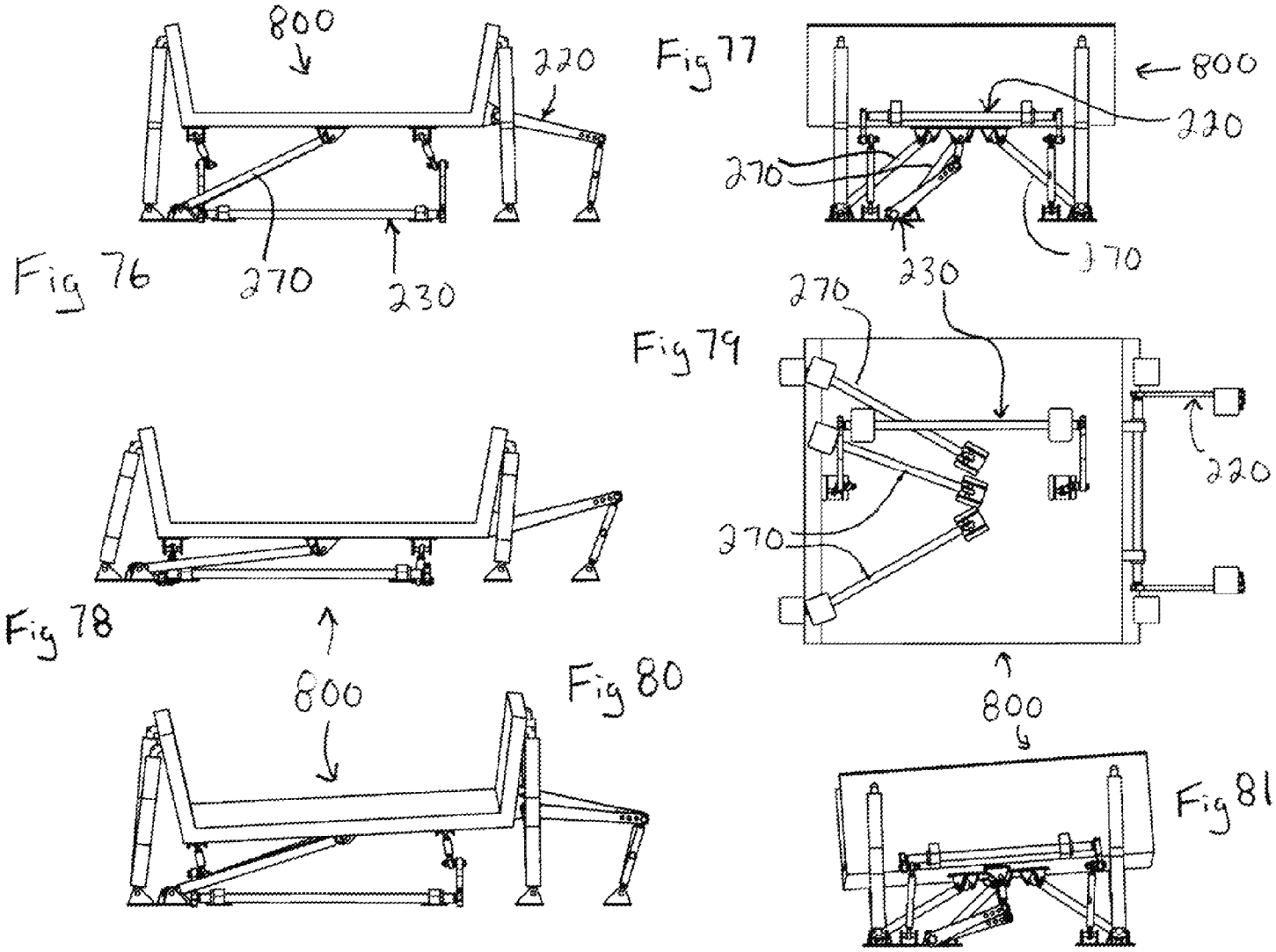
FIG. 76 is a starboard-side elevation view of the embodiment illustrated in FIG. 75, shown in the at-rest position.
FIG. 77 is a forward elevation view of the embodiment illustrated in FIG. 75, shown in the at-rest position.
FIG. 78 is a starboard-side elevation view of the embodiment illustrated in FIG. 75, shown in a compressed position.
FIG. 79 is a bottom plan view of the embodiment illustrated in FIG. 75, shown in a compressed position.
FIG. 80 is a starboard-side elevation view of the embodiment illustrated in FIG. 75, shown in a rolled-to-starboard position.
FIG. 81 is a forward elevation view of the embodiment illustrated in FIG. 75, shown in a rolled-to-starboard position.

Referring to FIGS. 75 through 81, there is illustrated an embodiment of the present invention comprising a marine platform 200 and an associated single three-spar-splayed roll-attenuation pitch-attenuation suspension system, generally referenced by numeral 800, mounted to a deck 204. In FIGS. 75 through 77, the embodiment is shown with the marine platform 200 in a no-load at-rest position. In FIGS. 78 and 79, the embodiment is shown with the marine platform 200 in a compressed position. In FIGS. 80 and 81, the embodiment is shown with the marine platform 200 rolled to starboard relative to the deck 204.

In the embodiment shown in FIGS. 75 through 81, the single three-spar-splayed roll-attenuation pitch-attenuation suspension system 800, includes four struts 206, a roll-attenuation assembly 220, a pitch-attenuation assembly 230, and three spars 270. The three spars 270 are generally splayed in that the spars 270 diverge in that the ends of the spars 270 mounted to the marine platform are closer one to the other than the ends of the spars 270 mounted to the deck 204.

Figure 82:
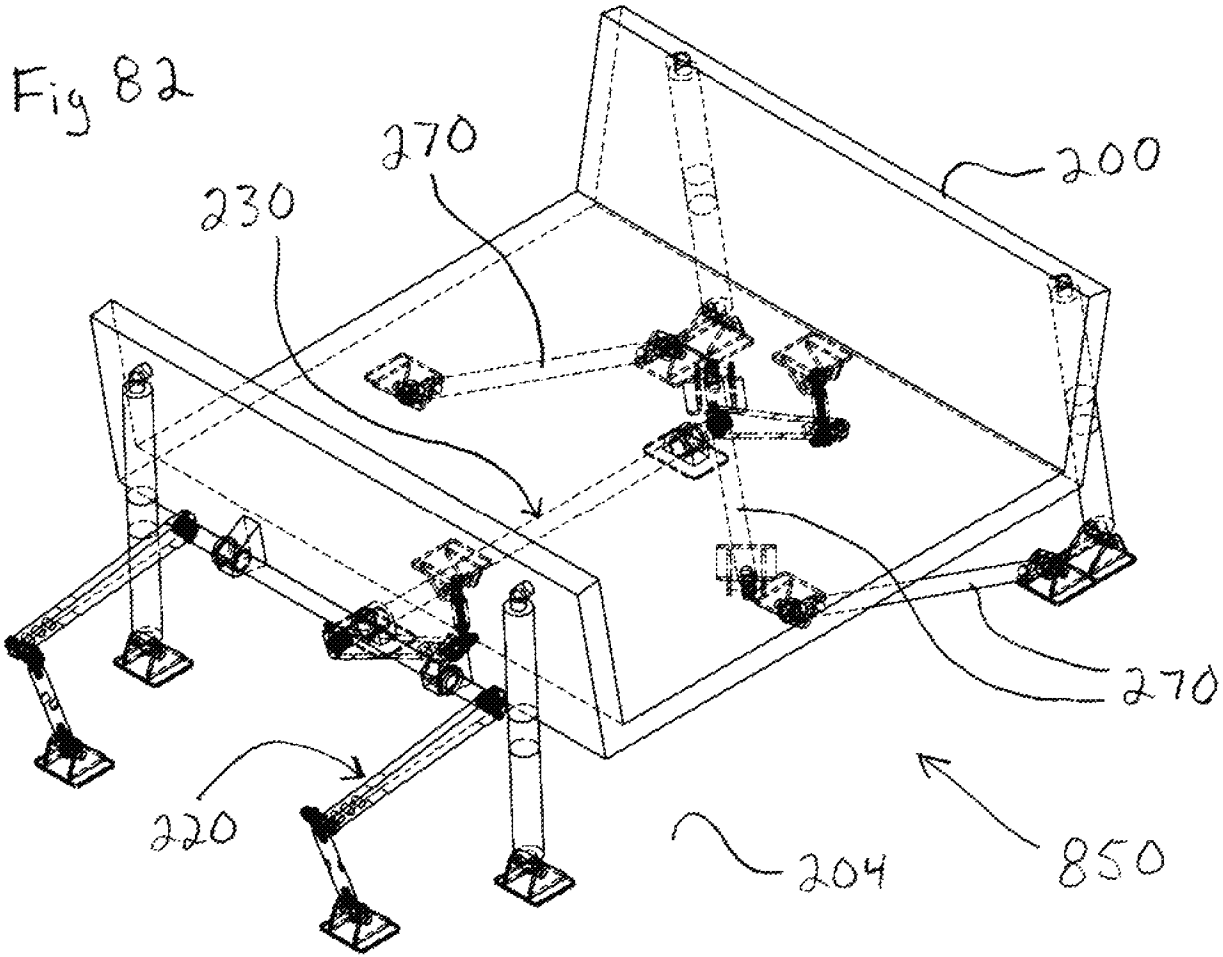
FIG. 82 is a forward-port-side isometric partially transparent view of a single three-spar Z-style roll-attenuation pitch-attenuation embodiment of the present invention, shown in the at-rest position.
Figures 83, 84, 85, 86, 87, 88:
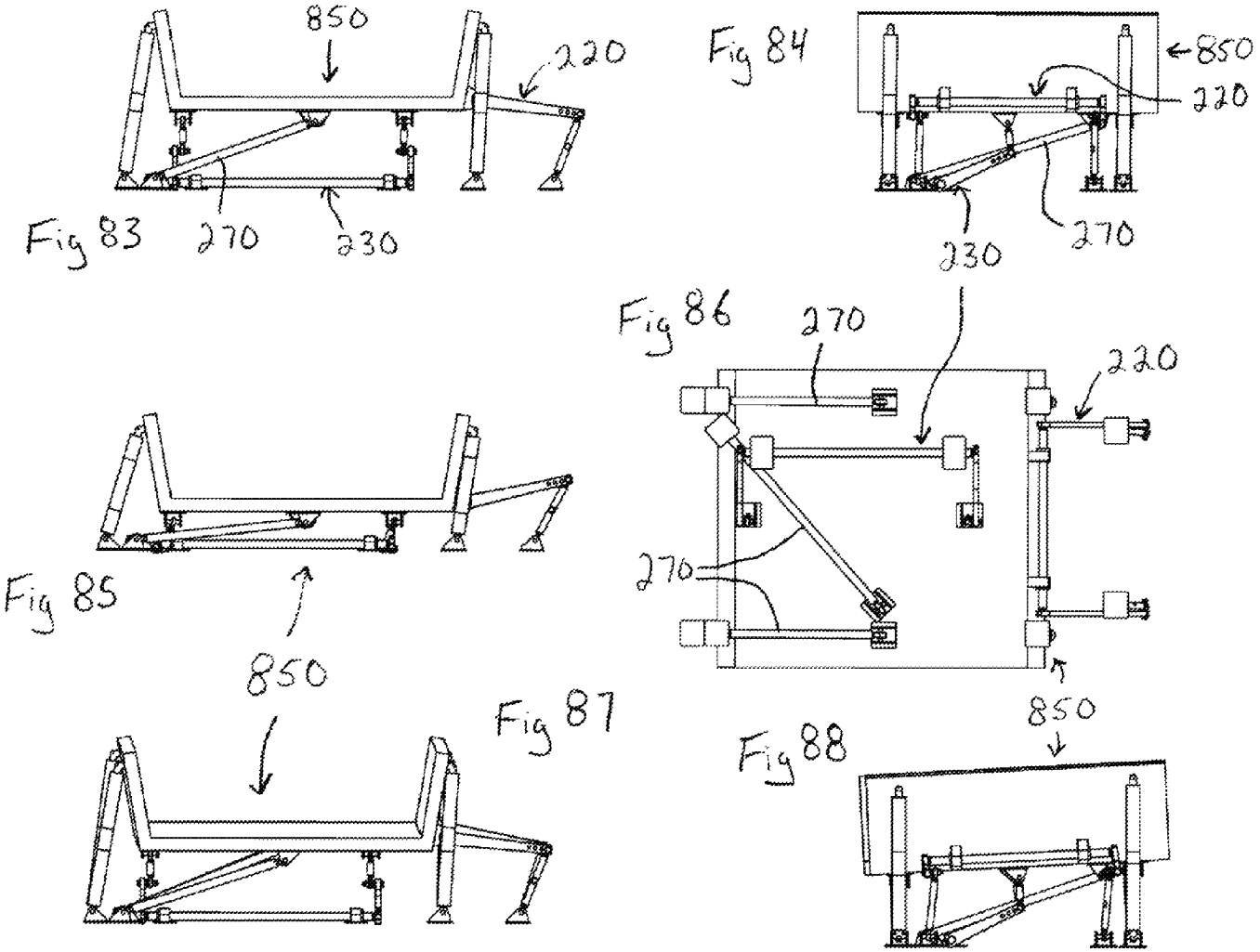
FIG. 83 is a starboard-side elevation view of the embodiment illustrated in FIG. 82, shown in the at-rest position.
FIG. 84 is a forward elevation view of the embodiment illustrated in FIG. 82, shown in the at-rest position.
FIG. 85 is a starboard-side elevation view of the embodiment illustrated in FIG. 82, shown in a compressed position.
FIG. 86 is a bottom plan view of the embodiment illustrated in FIG. 82, shown in a compressed position.
FIG. 87 is a starboard-side elevation view of the embodiment illustrated in FIG. 82, shown in a rolled-to-starboard position.
FIG. 88 is a forward elevation view of the embodiment illustrated in FIG. 82, shown in a rolled-to-starboard position.

Referring to FIGS. 82 through 88, there is illustrated an embodiment of the present invention comprising a marine platform 200 and an associated single three-spar Z-style roll-attenuation pitch-attenuation suspension system, generally referenced by numeral 850, mounted to a deck 204. In FIGS. 82 through 84, the embodiment is shown with the marine platform 200 in a no-load at-rest position. In FIGS. 85 and 86, the embodiment is shown with the marine platform 200 in a compressed position. In FIGS. 87 and 88, the embodiment is shown with the marine platform 200 rolled to starboard relative to the deck 204.

In the embodiment shown in FIGS. 82 through 88, the single three-spar Z-style roll-attenuation pitch-attenuation suspension system 850, includes four struts 206, a roll-attenuation assembly 220, a pitch-attenuation assembly 230, and three spars 270. The three spars 270 are generally arranged in the form of a Z, in that the two outer spars 270 (i.e., the spar 270 that is furthest starboard and the spar 270 that is furthest port) are essentially parallel one to the other, and the middle spar 270 extends essentially diagonally between them, extending from the vicinity of the end of the starboard-side spar 270 mounted to the deck 204 to the vicinity of the end of the port-side spar 270 mounted to the marine platform 200.

Figure 89:
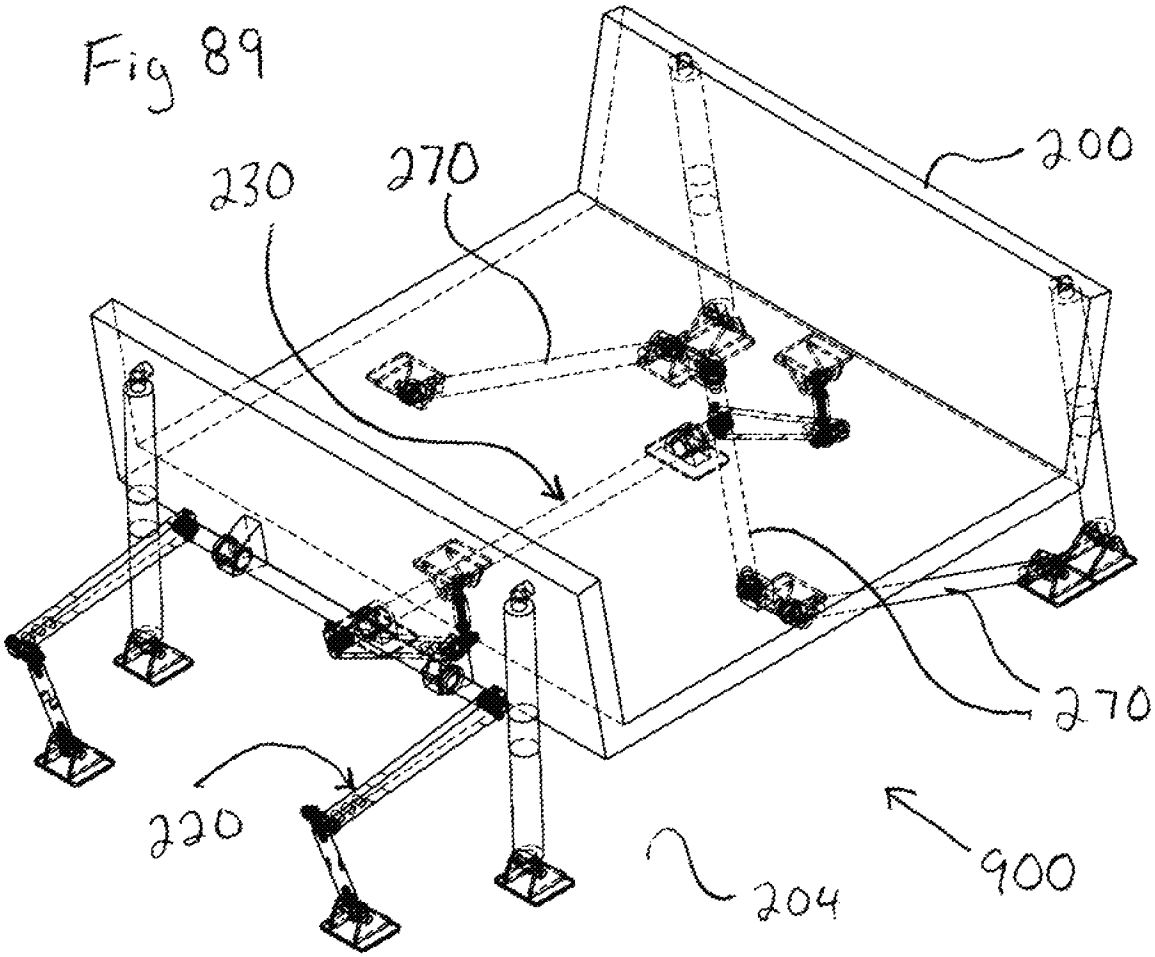
FIG. 89 is a forward-port-side isometric partially transparent view of a single three-spar Z-style roll-attenuation pitch-attenuation clevis-mount embodiment of the present invention, shown in the at-rest position.
Figures 90, 91, 92, 93, 94, 95:
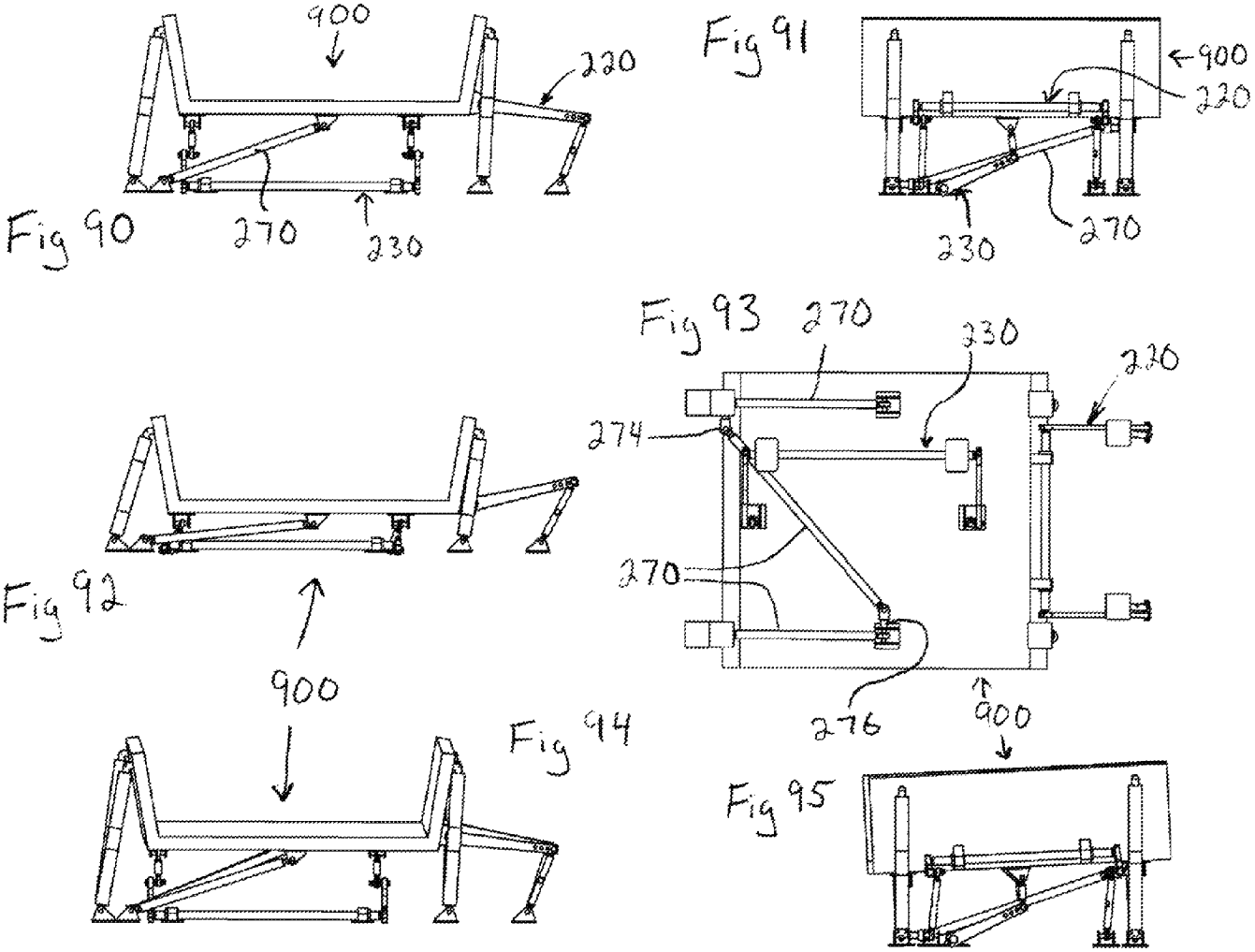
FIG. 90 is a starboard-side elevation view of the embodiment illustrated in FIG. 89, shown in the at-rest position.
FIG. 91 is a forward elevation view of the embodiment illustrated in FIG. 89, shown in the at-rest position.
FIG. 92 is a starboard-side elevation view of the embodiment illustrated in FIG. 89, shown in a compressed position.
FIG. 93 is a bottom plan view of the embodiment illustrated in FIG. 89, shown in a compressed position.
FIG. 94 is a starboard-side elevation view of the embodiment illustrated in FIG. 89, shown in a rolled-to-starboard position.
FIG. 95 is a forward elevation view of the embodiment illustrated in FIG. 89, shown in a rolled-to-starboard position.
Figure 96:
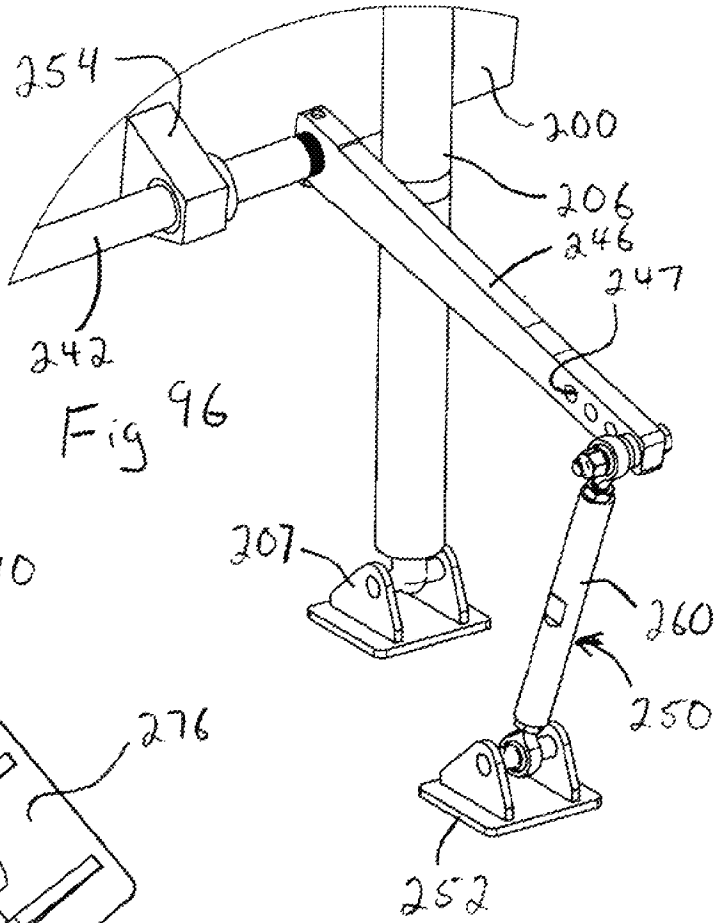
FIG. 96 is an isometric isolation view of a portion of an anti-sway assembly embodiment of the present invention.
Figure 97:
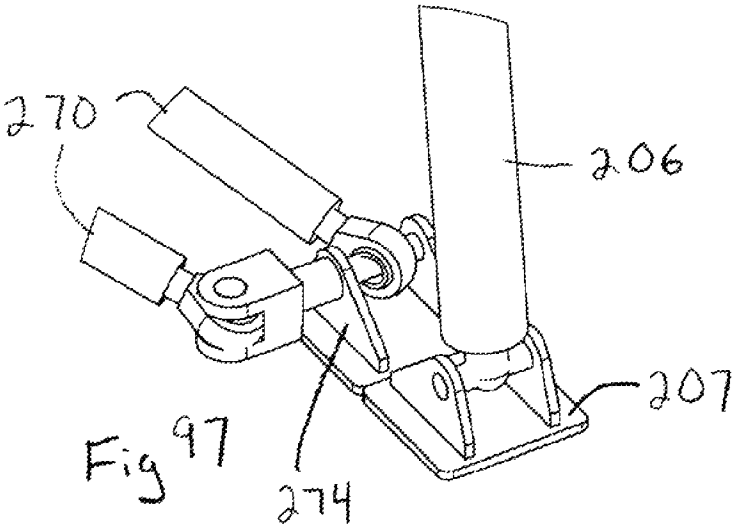
FIG. 97 is an isometric isolation view of an in-line clevis mount embodiment of the present invention.
Figure 98:
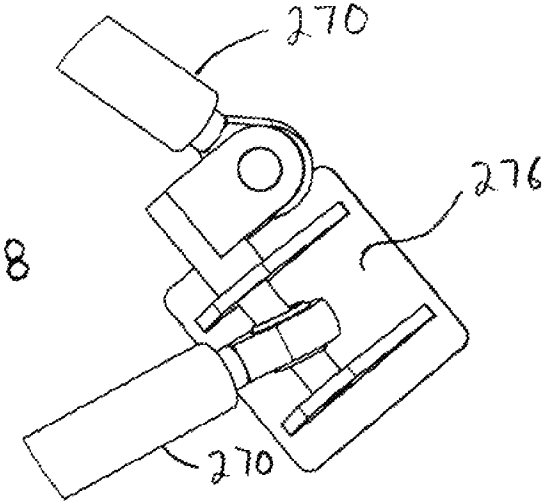
FIG. 98 is a bottom plan view of a laterally displaced clevis mount embodiment of the present invention.
Figure 99:
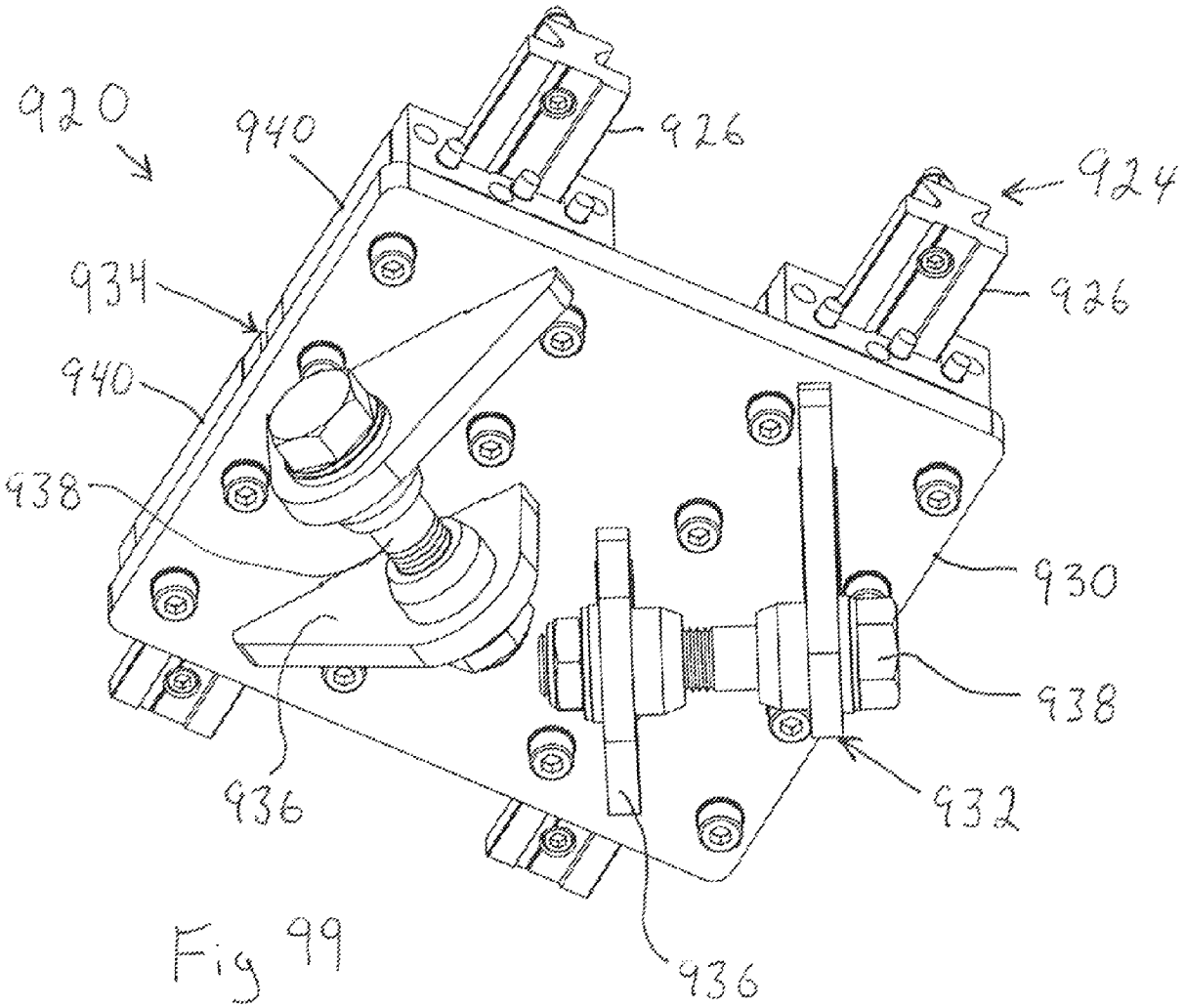
FIG. 99 is a perspective from-below isolation view of a sliding spar bracket embodiment.
Figure 100:
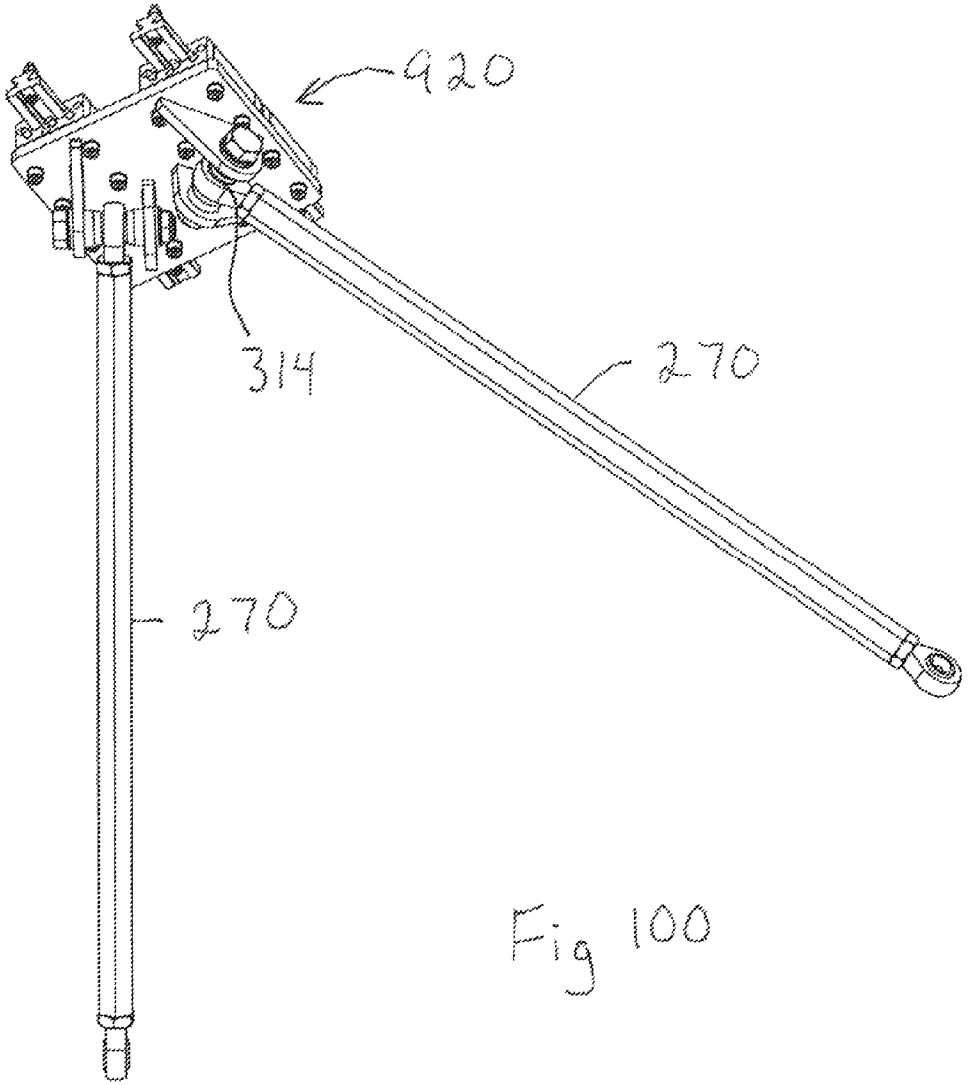
FIG. 100 is a perspective from-below isolation view of the sliding spar bracket embodiment of FIG. 99, shown with spars.
Figure 101:
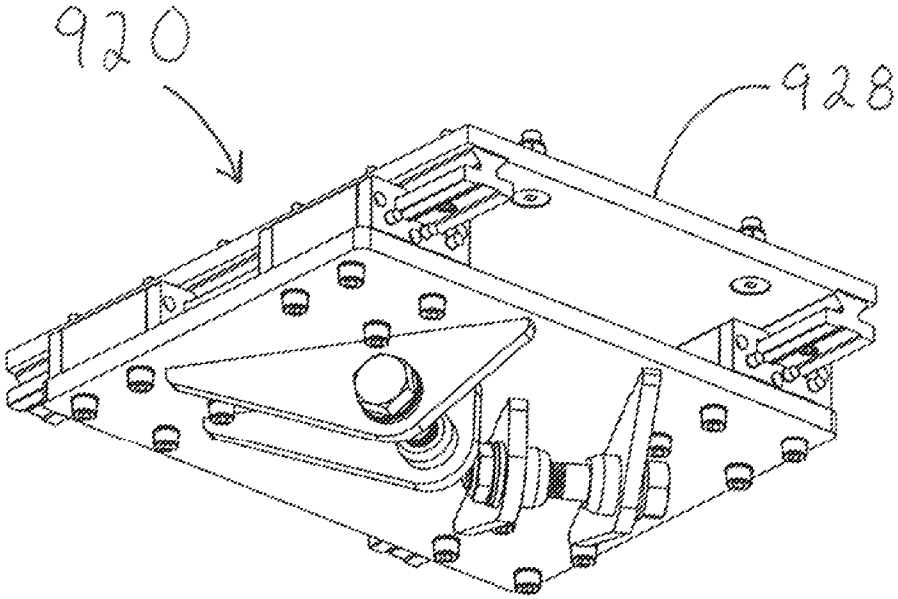
FIG. 101 is a perspective from-below isolation view of a sliding spar bracket with track mount embodiment.
Figure 102:
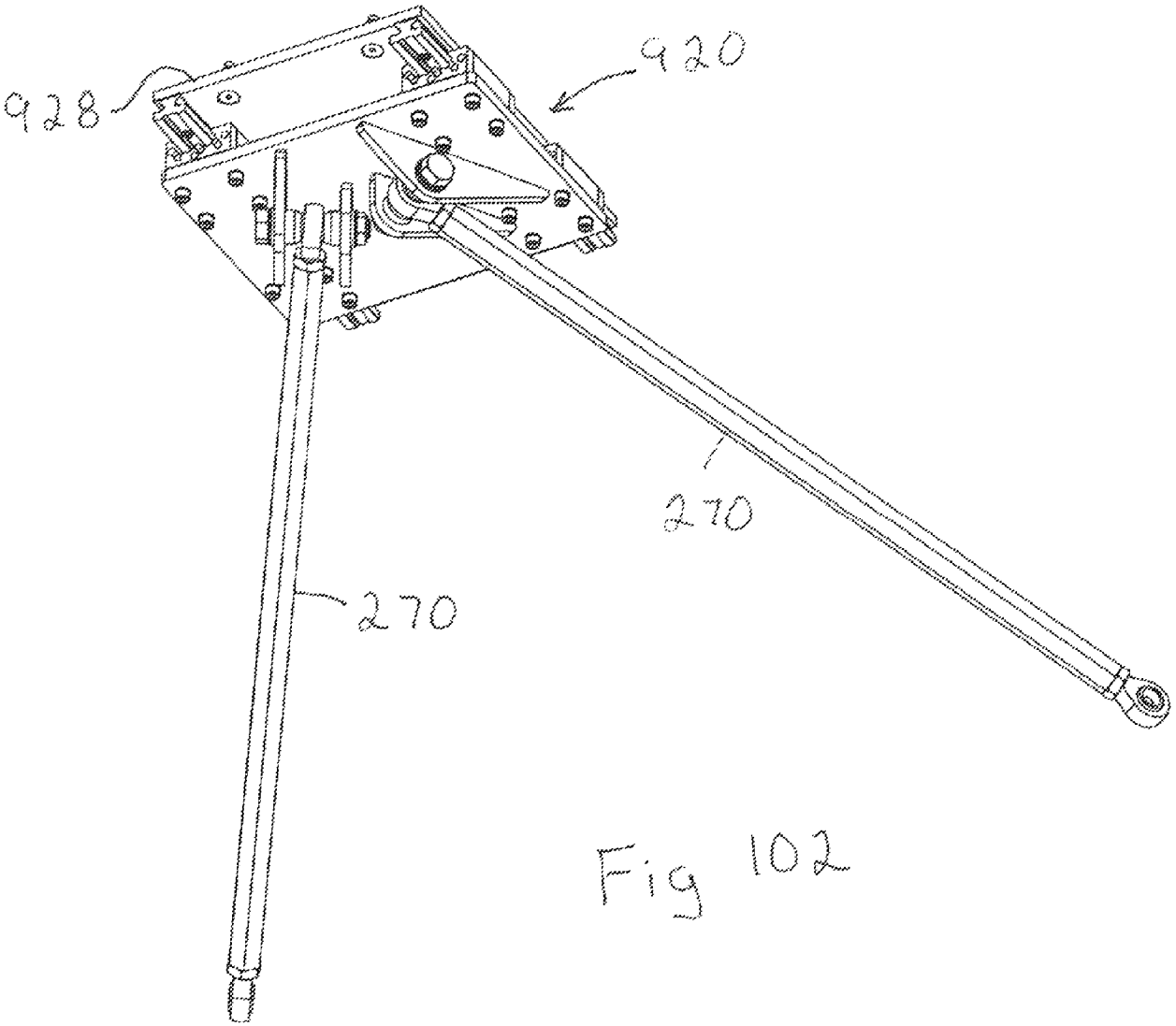
FIG. 102 is a perspective from-below isolation view of the sliding spar bracket with track mount embodiment of FIG. 101, shown with spars.

Referring to FIGS. 89 through 95, there is illustrated an embodiment of the present invention comprising a marine platform 200 and an associated single three-spar Z-style roll-attenuation pitch-attenuation clevis-mount suspension system, generally referenced by numeral 900, mounted to a deck 204. In FIGS. 89 through 91, the embodiment is shown with the marine platform 200 in a no-load at-rest position. In FIGS. 92 and 93, the embodiment is shown with the marine platform 200 in a compressed position. In FIGS. 94 and 95, the embodiment is shown with the marine platform 200 rolled to starboard relative to the deck 204.

In the embodiment shown in FIGS. 89 through 95, the single three-spar Z-style roll-attenuation pitch-attenuation clevis-mount suspension system 900, includes four struts 206, a roll-attenuation assembly 220, a pitch-attenuation assembly 230, and three spars 270. The three spars 270 are generally arranged in the form of a Z, in that the two outer spars 270 (i.e., the spar 270 that is furthest starboard and the spar 270 that is furthest port) are essentially parallel one to the other, and the middle spar 270 extends essentially diagonally between them, extending from the vicinity of the end of the starboard-side spar 270 mounted to the deck 204 to the vicinity of the end of the port-side spar 270 mounted to the marine platform 200.

As indicated most clearly in FIG. 93, in the single three-spar Z-style roll-attenuation pitch-attenuation clevis-mount suspension system 900, the middle spar 270 and starboard-side spar 270 are mounted to the deck 204 with a spar clevis bracket 274; and the middle spar 270 and port-side spar 270 are mounted to the marine platform 200 with a spar clevis lateral bracket 276.

Referring to FIGS. 99 to 110 there are shown movement-accommodating spar brackets which permit relative fore and aft movement as between the spars 270 (or forward wishbone 302 or aft wishbone 304) and marine platform 200, or the deck 204, that the movement-accommodating spar bracket is interconnecting. The movement-accommodating spar bracket embodiments illustrated in the drawings are a sliding spar bracket 930 and pivoting spar bracket 950, which are configured for interconnecting two spars 270 to a marine platform 200.

As indicated in FIGS. 99-102, the sliding spar bracket 930 comprises a track assembly 922 and a slide assembly 924.

The track assembly 922 comprises two spaced-apart parallel tracks 926 having a general "T" configuration. The track assembly 922 may also include a track mount 928, being, in the embodiments shown in the drawings, a plate suitable for maintaining the relative orientation of the tracks 926 during use and for affixing to the marine platform 200. Alternatively, the tracks 926 may be affixed directly to the marine platform 200.

The slide assembly 924 comprises a slide assembly body 930, two spar connectors 932 on the lower side of the slide assembly body 930 and two spaced apart aligned car assemblies 934 on the upper side of the slide assembly body 930.

Each spar connector 932 comprises two parallel projecting tangs 936 configured (including each having a hole therethrough) for receiving the heir joint 314 of a respective spar 270 and securing same with a heim joint fastener 938. The spar connectors 932 are angled relative to each other so as to be aligned with a pair of spars 270 oriented in the shape of a V, with the base of the V attached to the spar connectors 932 and the top of the V attached to the deck 204.

Each car assembly 934 comprises one or more aligned cars 940 configured for slidable engagement with a respective track 926. As will be apparent from the drawings, when engaged one with the other, the slide assembly 924 and track assembly 922 are constrained to undergoing relative reciprocating linear movement.

To obtain the desired alignment (and thus low friction), as the slide assembly body 930 is preferably metal (preferably stainless steel plate) and the tangs 936 are preferably welded to the slide assembly body 930, the face of the slide assembly body 930 to which the tracks 926 are affixed, is preferably machined after the tangs 936 are attached to remove any distortion caused by the welding.

Given the marine environment to which they are exposed in use, the tracks 926 and cars 940 are preferably corrosion resistant and low friction without lubrication. The tracks 926 are preferably anodized aluminum T-rail. The cars 940 preferably comprise anodized aluminum bodies with low-friction plastic sliding elements.

It has been found that products provided by IGUS GmbH and IGUS Inc. are suitable for use as cars 940 and tracks 926, namely DryLin@ T—profile rail series, specifically car part no. TW-01-25 and rail part no. TS-01-25 (the car is 6063-T6 Aluminum and clear anodized, and the rail is 6063-T6 Aluminum and hard anodized). The IGUS GmbH and IGUS Inc. cars in include a sliding element made from iglide@ J material and the sliding elements are adjustable with stainless steel screws.

Figure 103:
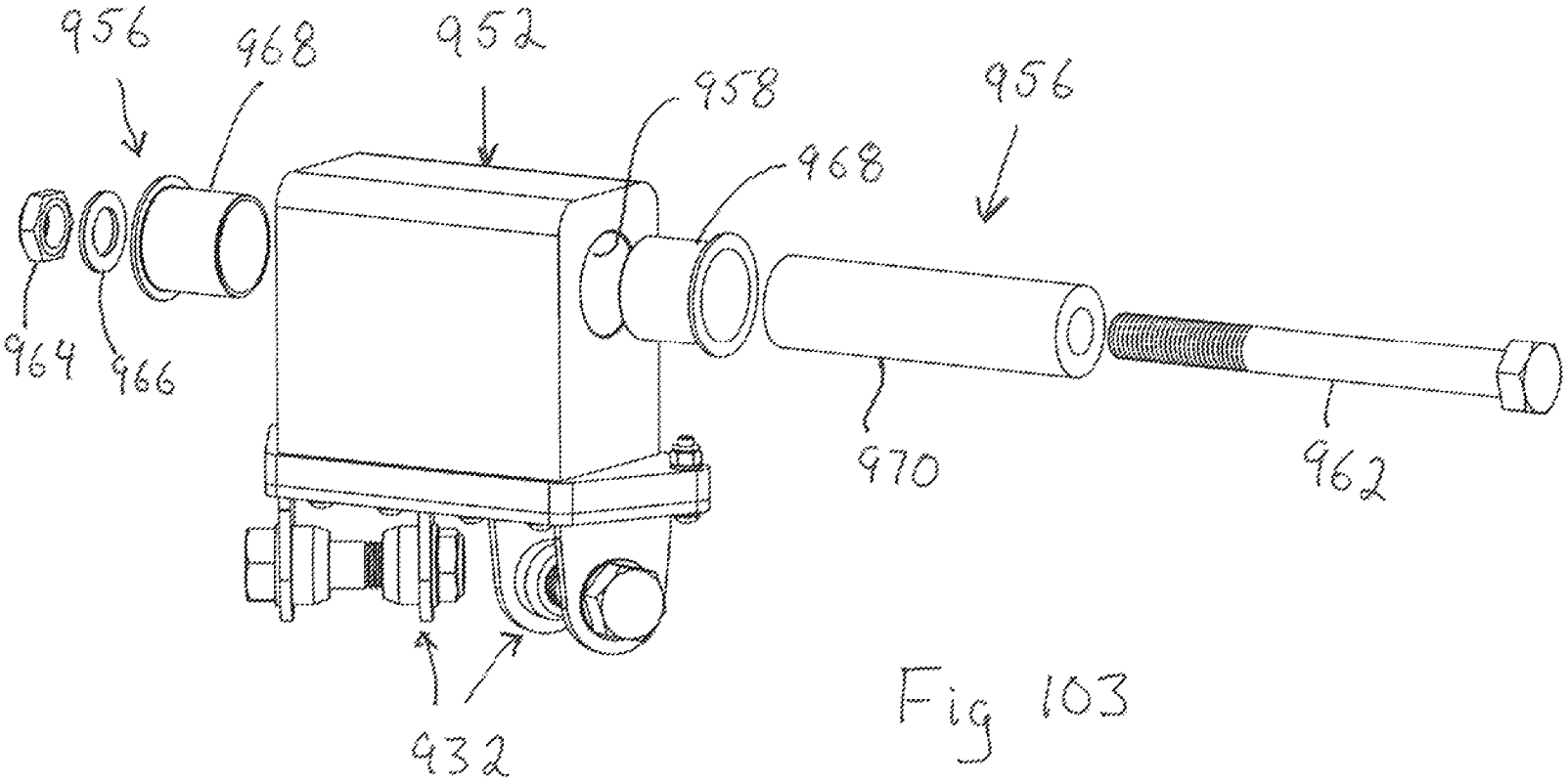
FIG. 103 is a perspective exploded view of a pivot block and pivot pin assembly embodiment.
Figure 104:
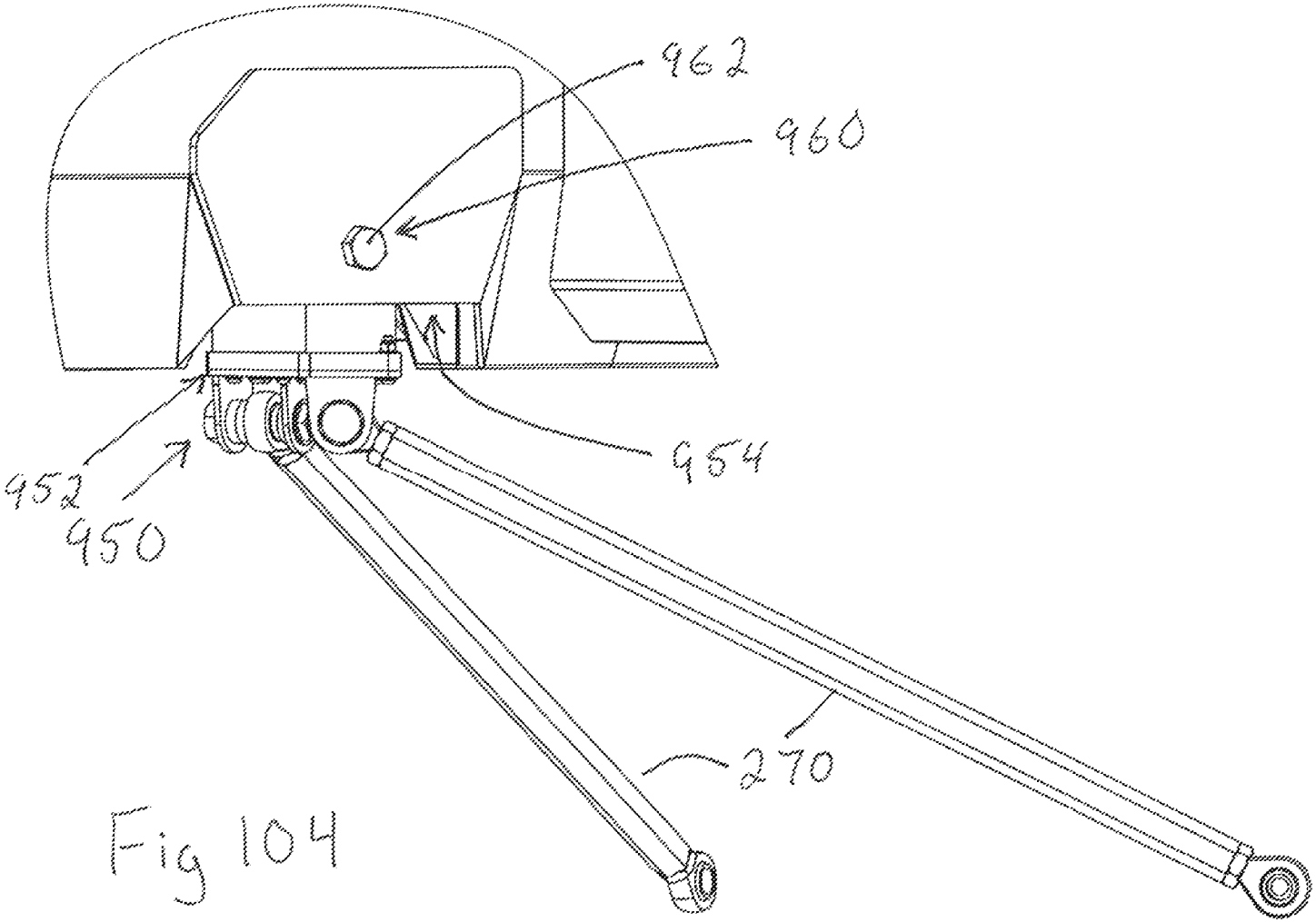
FIG. 104 is a cutaway perspective view of a pivoting spar bracket embodiment, shown with spars.

As indicated in FIGS. 103 and 104, the pivoting spar bracket 950 comprises a pivot block 952, a pivot cavity 954 and pivot pin assembly 956.

The pivot block 952 includes two spar connectors 932 oriented in the same manner as the spar connectors 932 of the sliding spar bracket 920. The pivot block 952 includes a pivot block bore 958.

The pivot cavity 954 includes a recess for receiving the pivot block 952 and two pivot cavity holes 960. The pivot cavity 954 may be a separate component affixed to the marine platform 200 or may be integral to the marine platform 200.

The pivot pin assembly 956 includes a pivot bolt 962, pivot nut 964, pivot washer 966, two pivot sleeves 968 and a pivot bushing 970.

The pivoting spar bracket 950 is assembled by: inserting a pivot sleeve 968 into each end of the pivot block bore 958; inserting the pivot bushing 970 into the pivot sleeves 968; positioning the pivot block 952 within the pivot cavity 954 so as to bring the pivot block bore 958 into alignment with the pivot cavity holes 960; inserting the pivot bolt 962 therethrough; and securing the pivot bolt 962 with the pivot nut 964 and pivot washer 966.

It has been found that the Iglide® J material provided by IGUS GmbH and IGUS Inc. is suitable for use as pivot bushing 970, for example bushing part no: JFI-2428-24.

Double two-spar roll-attenuation embodiments of the present invention with movement-accommodating spar brackets are shown in the drawings.

Figure 105:
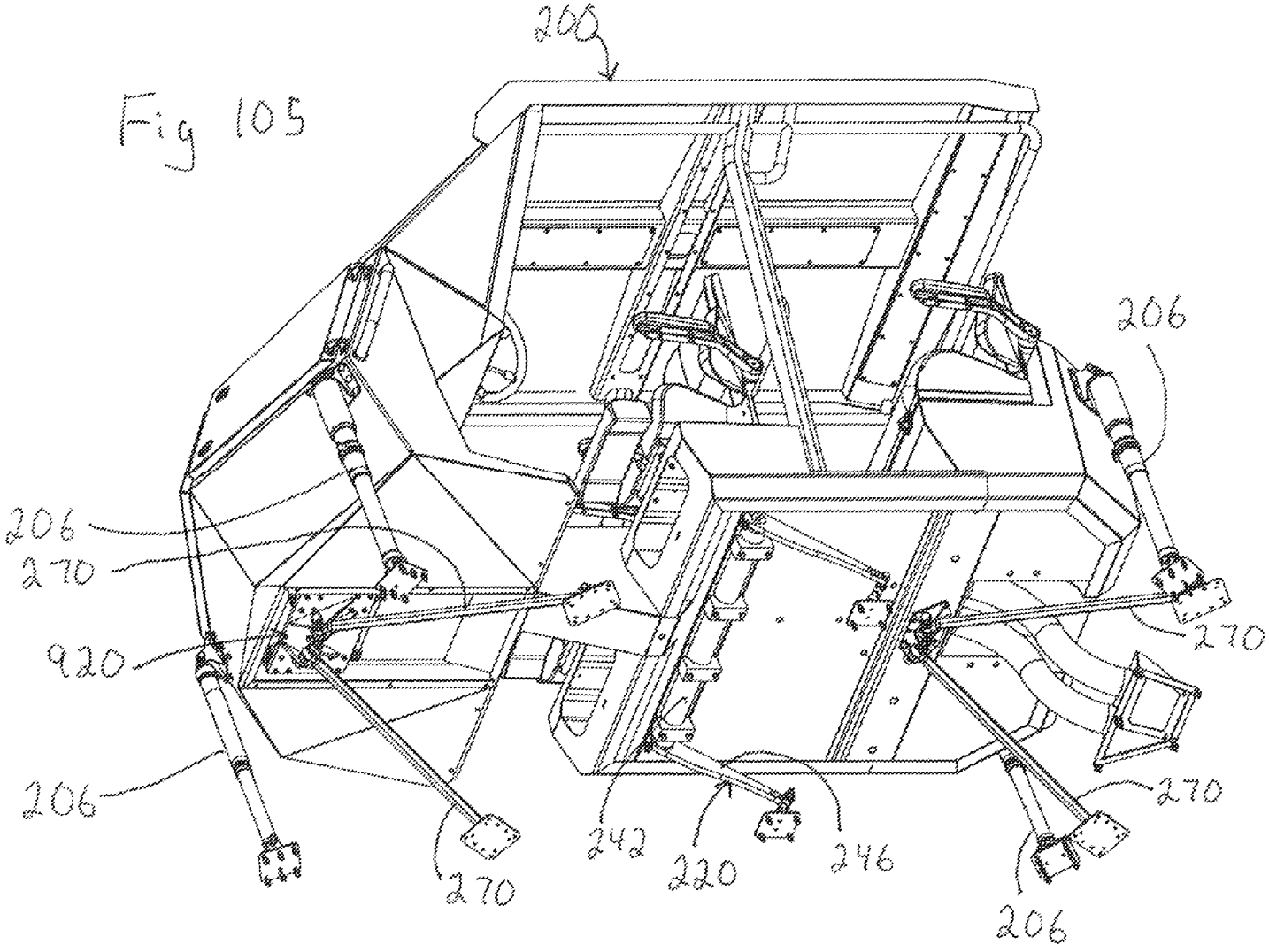
FIG. 105 is a perspective from-below view of a double two-spar roll-attenuation embodiment of the present invention with movement-accommodating spar brackets wherein the forward spars are interconnected to the marine platform via a sliding spar bracket and the torsion spring is attached to the marine platform roughly in the middle of the fore and aft extent of the marine platform and with the adjustable torsion arms extending aft from the torsion spring.
Figure 106:
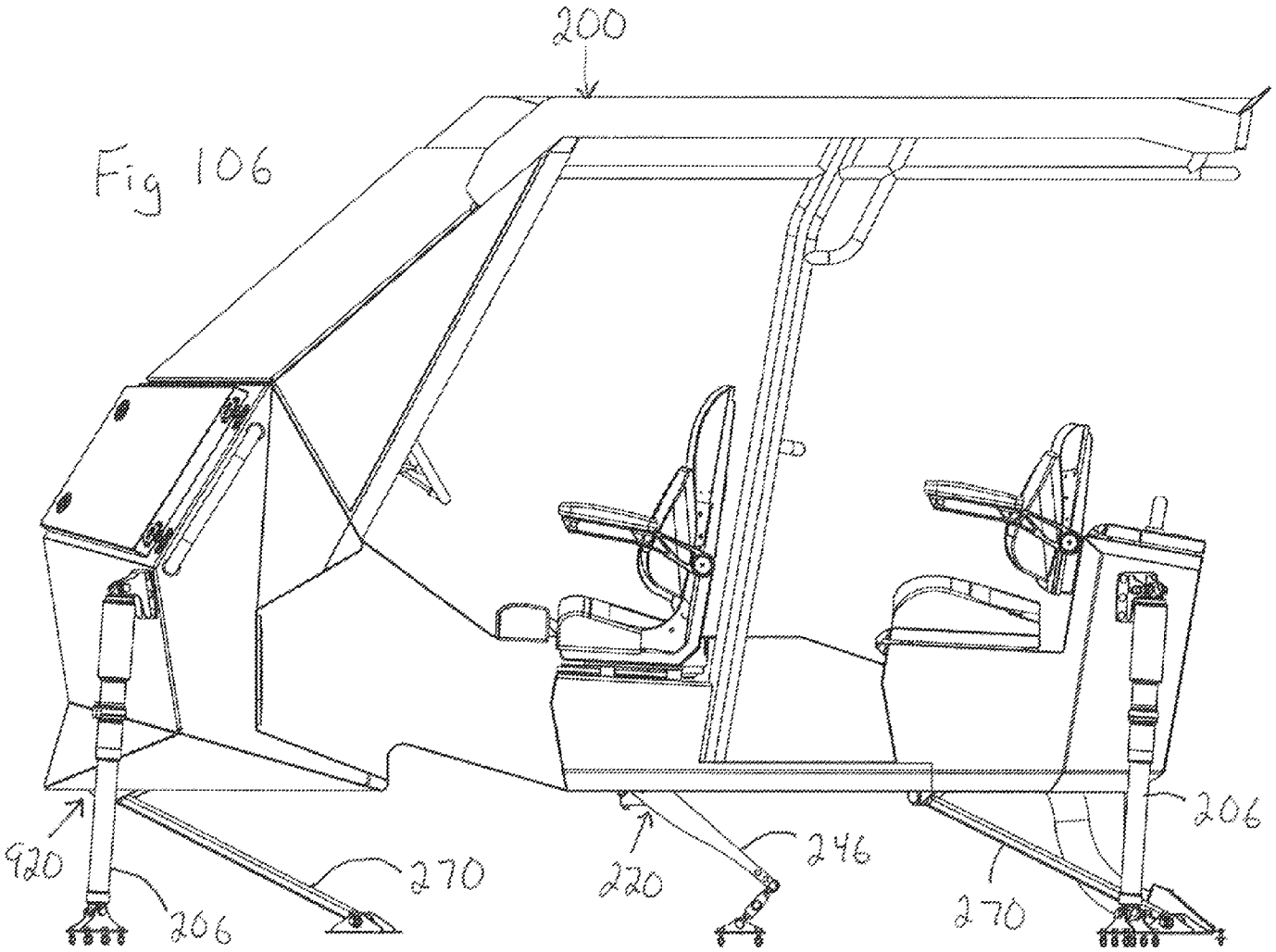
FIG. 106 is a side elevation view of embodiment shown in FIG. 105.

FIGS. 105 and 106 show a double two-spar roll-attenuation embodiment of the present invention with movement-accommodating spar brackets wherein the forward spars 270 are interconnected to the marine platform 200 via a sliding spar bracket 920 and the torsion spring 242 is attached to the marine platform 200 roughly in the middle of the fore and aft extent of the marine platform and with the adjustable torsion arms 246 extending aft from the torsion spring 242.

Figure 107:
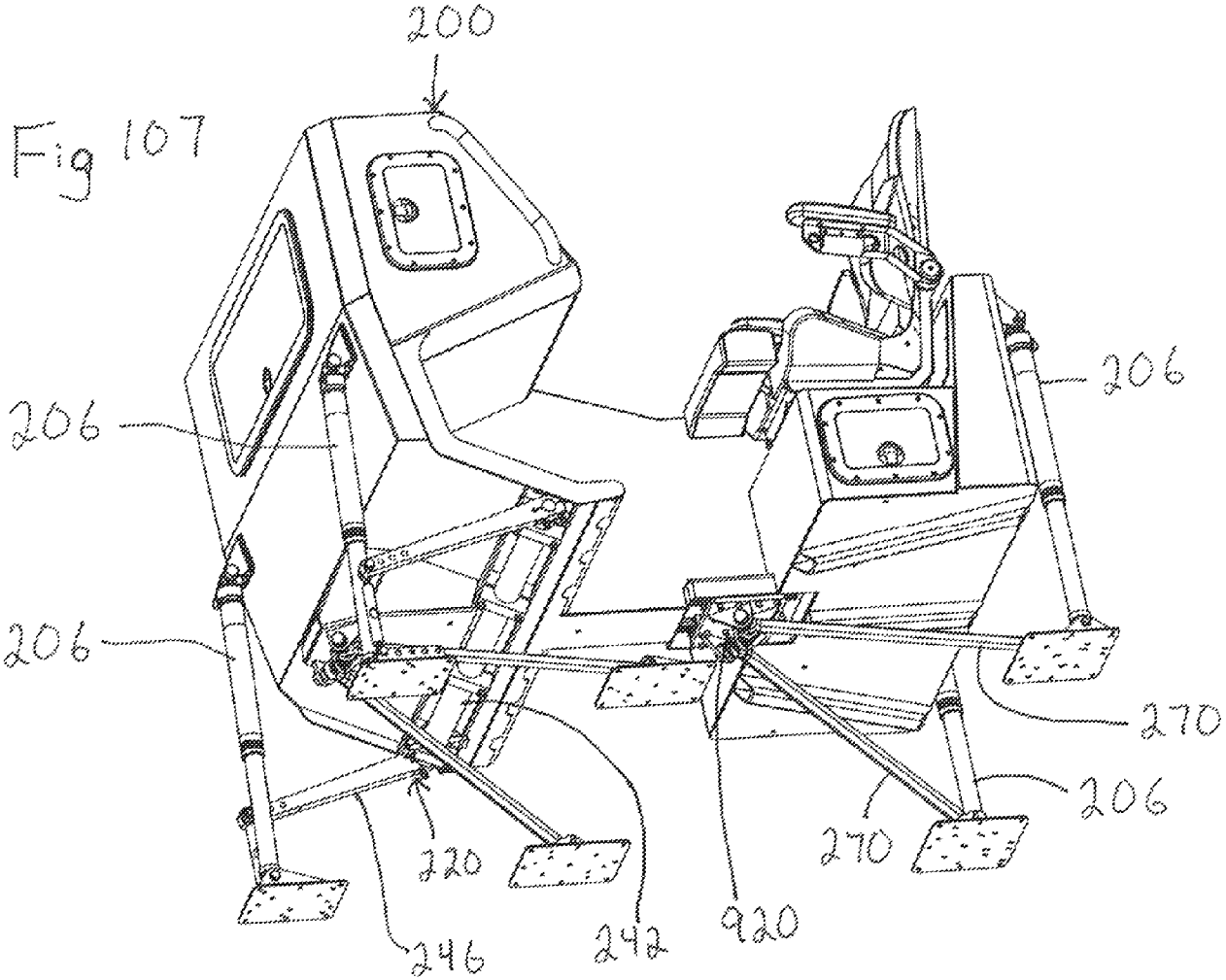
FIG. 107 is a perspective from-below view of a double two-spar roll-attenuation embodiment of the present invention with movement-accommodating spar brackets wherein the aft spars are interconnected to the marine platform via a sliding spar bracket and the torsion spring is attached to the marine platform toward the forward end of the marine platform and with the adjustable torsion arms extending forward from the torsion spring.
Figure 108:
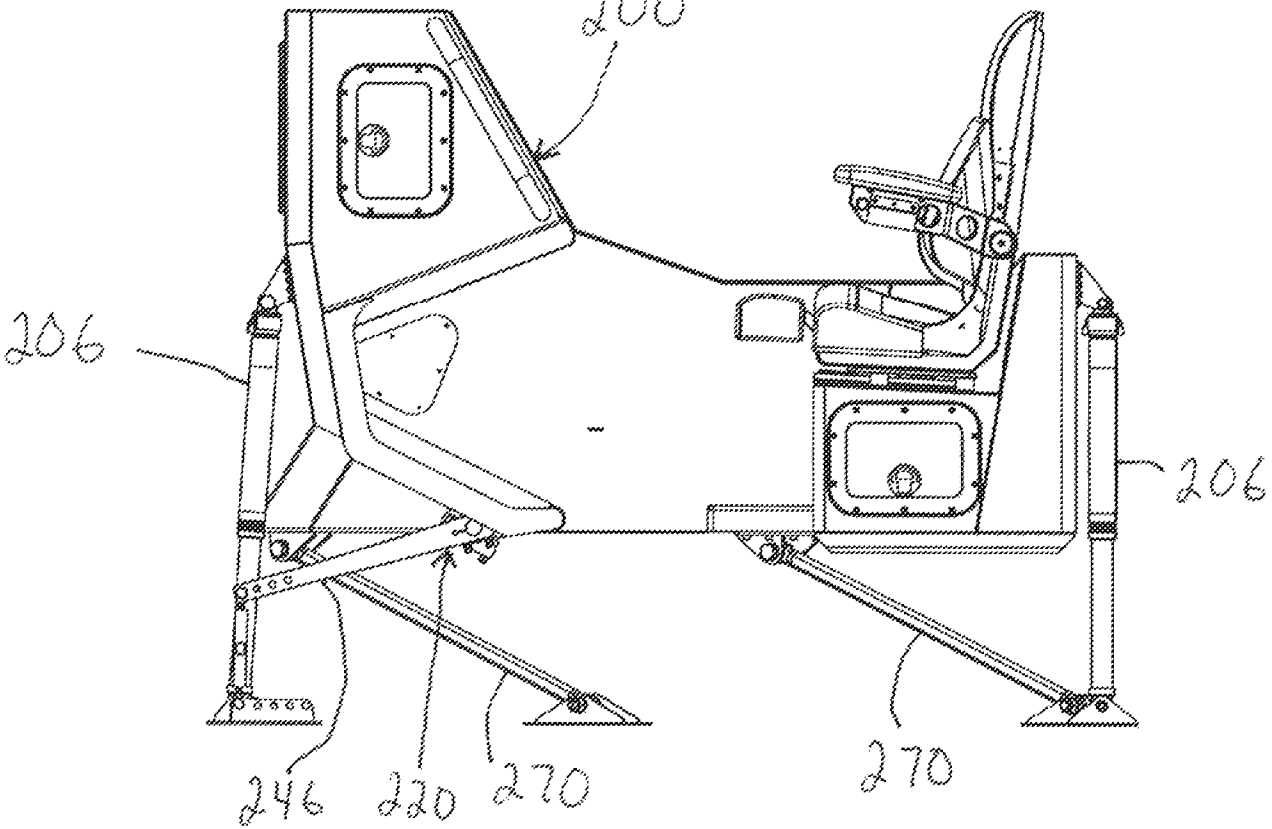
FIG. 108 is a side elevation view of embodiment shown in FIG. 107.

FIGS. 107 and 108 show a double two-spar roll-attenuation embodiment of the present invention with movement-accommodating spar brackets wherein the aft spars 270 are interconnected to the marine platform 200 via a sliding spar bracket 920 and the torsion spring 242 is attached to the marine platform 200 toward the forward end of the marine platform and with the adjustable torsion arms 246 extending forward from the torsion spring 242.

Figure 109:
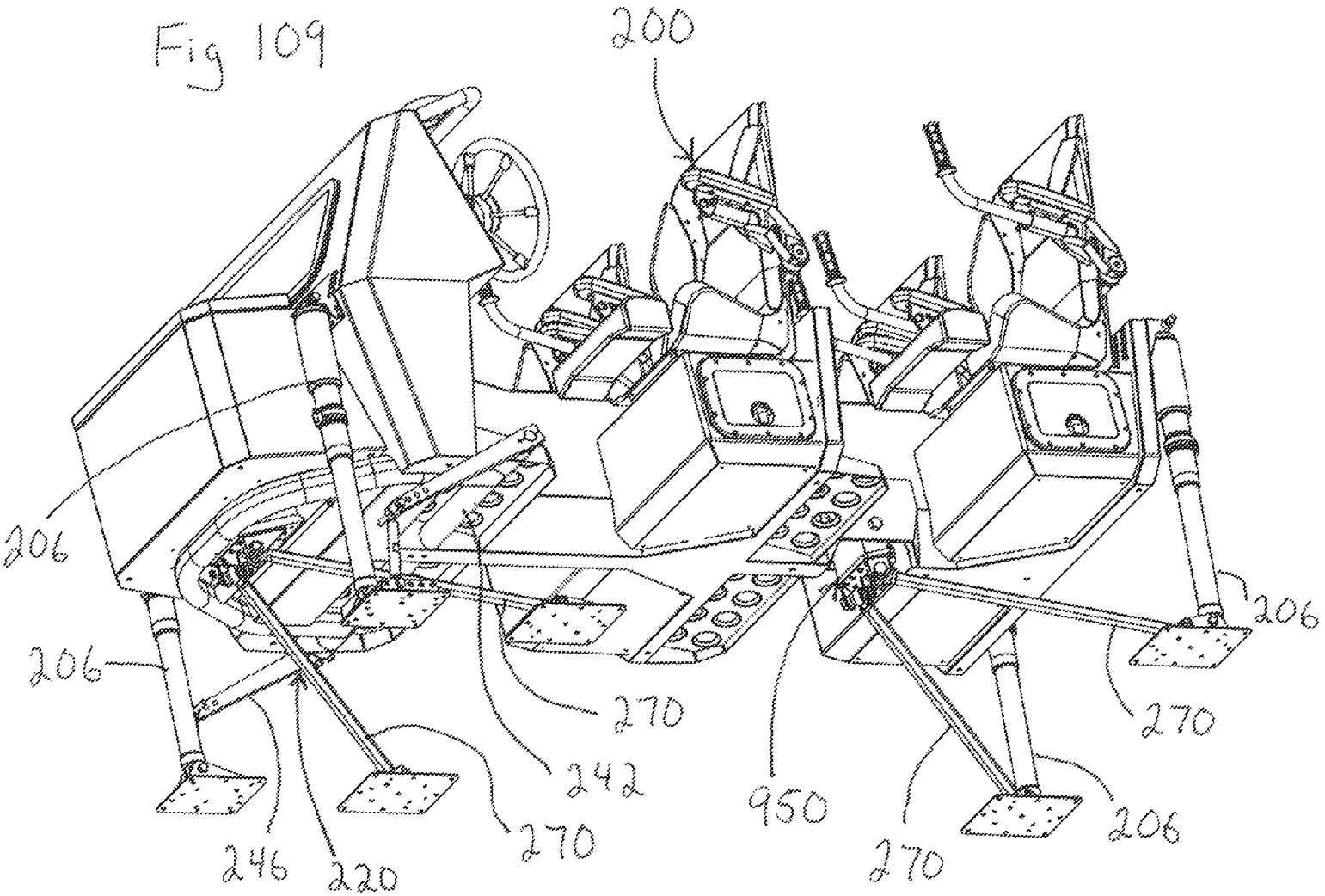
FIG. 109 is a perspective from-below view of a double two-spar roll-attenuation embodiment of the present invention with movement-accommodating spar brackets wherein the aft spars are interconnected to the marine platform via a pivoting spar bracket and the torsion spring is attached to the marine platform toward the forward end of the marine platform and with the adjustable torsion arms extending forward from the torsion spring.
Figure 110:
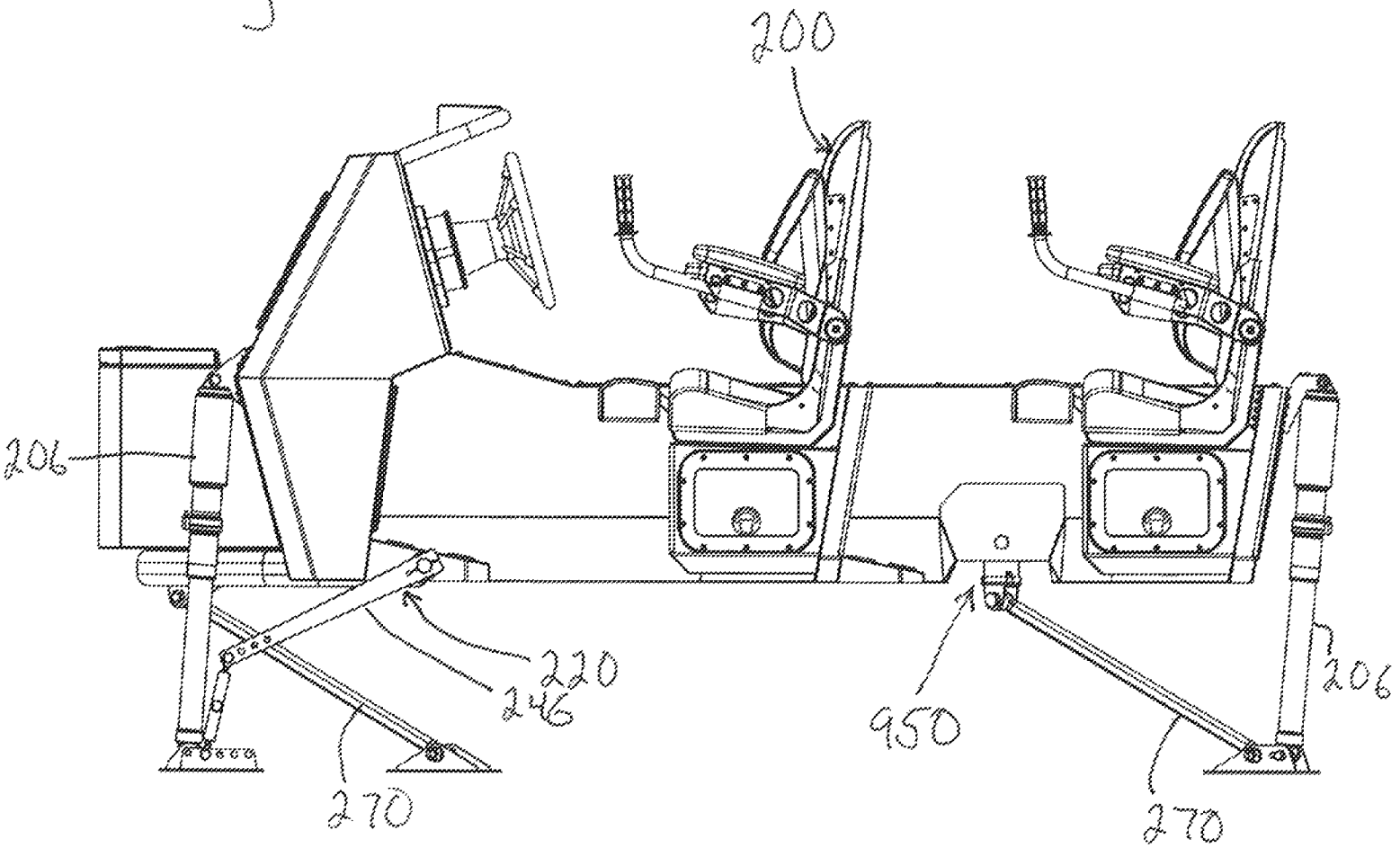
FIG. 110 is a side elevation view of embodiment shown in FIG. 109.

FIGS. 109 and 110 show a double two-spar roll-attenuation embodiment of the present invention with movement-accommodating spar brackets wherein the aft spars 270 are interconnected to the marine platform 200 via a pivoting spar bracket 950 and the torsion spring 242 is attached to the marine platform 200 toward the forward end of the marine platform and with the adjustable torsion arms 246 extending forward from the torsion spring 242.

It will be apparent that the movement-accommodating spar brackets permit relative differential vertical movement as between the forward and aft portions of the marine platform 200, which improves suspension performance in terms of response to pitch.

The sliding spar bracket 920 and pivoting spar bracket 950 are preferably configured to accommodate the maximum permitted differential movement as between the forward and aft portions of the marine platform 200, in terms of the simultaneous maximum compression of the forward struts 206 and maximum extension of the aft struts 206, or the simultaneous maximum extension of the forward struts 206 and maximum compression of the aft struts 206.

Similar permitted relative differential vertical movement as between the forward and aft portions of the marine platform 200 could be provided by interconnecting the two spars 270 to the deck 204 with a movement accommodating mounting (not shown), although it is understood that it is simpler and thus preferably to have a single movement accommodating component there the spars 270 converge (i.e., as described above).

What is claimed is:

1. A suspension system for a suspended marine platform on a high-speed water vessel having a usual direction of travel, the suspension system comprising:

a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position;

two spar assemblies, being a first spar assembly and a second spar assembly, and each spar assembly comprising a first spar and a second spar, each spar pivotally attached at a proximal end to the vessel and at a distal end to the marine platform, wherein:

the proximal ends are aft of the distal ends; and the proximal ends of the spars are spaced athwart one from the other a greater distance than the distal ends of the spars are spaced athwart one from the other, wherein the first spar assembly is forward of the second spar assembly; and wherein:

the attachment of one spar of the spar assemblies to the vessel permits relative fore and aft movement between the vessel and the proximal ends of the spars of said one of the spar assemblies; or the attachment of one of the spar assemblies to the marine platform permits relative fore and aft movement between the marine platform and the distal ends of the spars of said one of the spar assemblies.

2. The suspension system of claim 1, wherein the attachment of said one of the spar assemblies to the marine platform permits relative fore and aft movement between the marine platform and the distal ends of the spars of said one of the spar assemblies.

3. The suspension system of claim 2, wherein the relative fore and aft movement between the marine platform and the distal ends of the spars of said one of the spar assemblies is linear.

4. The suspension system of claim 3, wherein the relative fore and aft movement between the marine platform and the distal ends of the spars of said one of the spar assemblies is provided by a track and car assembly.

5. The suspension system of claim 2, wherein the relative fore and aft movement between the marine platform and the distal ends of the spars of said one of the spar assemblies is arcuate.

6. The suspension system of claim 5, wherein the relative fore and aft movement between the marine platform and the distal ends of the spars of said one of the spar assemblies is provided by a pivot assembly.

7. The suspension system of claim 1, further comprising a roll-attenuation assembly interconnected between the marine platform and the vessel.

8. The suspension system of claim 7, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel.

9. The suspension system of claim 1, wherein in one of the spar assemblies, the first spar and second spar are fixed one to the other in the vicinity of their distal ends and share a common pivotal attachment to the marine platform.

10. The suspension system of claim 1, wherein the shock absorbing assembly comprises four shock-absorbing struts interconnected between the marine platform and the vessel.

11. A suspension system for a suspended marine platform on a high-speed water vessel having a usual direction of travel, the suspension system comprising:

a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position;

two spar assemblies being a first spar assembly and a second spar assembly, and each spar assembly comprising a first spar and a second spar, each spar pivotally attached at a proximal end to the vessel and at a distal end to the marine platform, wherein:

the proximal ends are aft of the distal ends; and the proximal ends of the spars are spaced athwart one from the other a greater distance than the distal ends of the spars are spaced athwart one from the other;

wherein the first spar assembly is forward of the second spar assembly;

wherein the attachment of one of the spar assemblies to the marine platform comprises a track and car assembly so as to permit relative linear fore and aft movement between the marine platform and the distal ends of the spars of said one of the spar assemblies; and;

further comprising a roll-attenuation assembly interconnected between the marine platform and the vessel.

12. The suspension system of claim 11, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel.

13. The suspension system of claim 11, wherein the shock absorbing assembly comprises four shock-absorbing struts interconnected between the marine platform and the vessel.

14. A suspension system for a suspended marine platform on a high-speed water vessel having a usual direction of travel, the suspension system comprising:

a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position;

two spar assemblies, being a first spar assembly and a second spar assembly, and each spar assembly comprising a first spar and a second spar, each spar pivotally attached at a proximal end to the vessel and at a distal end to the marine platform, wherein:

the proximal ends are aft of the distal ends; and the proximal ends of the spars are spaced athwart one from the other a greater distance than the distal ends of the spars are spaced athwart one from the other;

wherein the first spar assembly is forward of the second spar assembly;

wherein the attachment of one of the spar assemblies to the marine platform comprises a pivot assembly so as to permit relative arcuate fore and aft movement between the marine platform and the distal ends of the spars of said one of the spar assemblies; and;

further comprising a roll-attenuation assembly interconnected between the marine platform and the vessel.

15. The suspension system of claim 14, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel.

16. The suspension system of claim 14, wherein the shock absorbing assembly comprises four shock-absorbing struts interconnected between the marine platform and the vessel.

* * * * *